US009655447B2

(12) United States Patent
Brunnmayr et al.

(10) Patent No.: US 9,655,447 B2
(45) Date of Patent: May 23, 2017

(54) DRIVE DEVICE FOR A MOVABLE FURNITURE PART

(71) Applicant: Julius Blum GmbH, Hoechst (AT)

(72) Inventors: Harald Brunnmayr, Hoerbranz (AT); Michael Blum, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 2 days.

(21) Appl. No.: 14/847,577

(22) Filed: Sep. 8, 2015

(65) Prior Publication Data

US 2015/0374124 A1 Dec. 31, 2015

Related U.S. Application Data

(63) Continuation of application No. PCT/AT2014/000059, filed on Mar. 26, 2014.

(30) Foreign Application Priority Data

Apr. 12, 2013 (AT) ..... A 293/2013

(51) Int. Cl.
*A47B 88/04* (2006.01)
*A47B 88/931* (2017.01)
(Continued)

(52) U.S. Cl.
CPC ..... *A47B 88/0477* (2013.01); *A47B 88/40* (2017.01); *A47B 88/463* (2017.01); *A47B 88/47* (2017.01); *A47B 88/931* (2017.01)

(58) Field of Classification Search
CPC . A47B 88/04; A47B 88/0477; A47B 88/0481; A47B 88/0085; A47B 88/47; A47B 88/463; A47B 88/931; A47B 88/40
(Continued)

(56) References Cited

U.S. PATENT DOCUMENTS 4,657,292 A 4/1987 Bruck
5,386,636 A * 2/1995 Asano ..... B60R 7/06 292/201

(Continued)

FOREIGN PATENT DOCUMENTS

AT 511 938 4/2013
CN 102370350 3/2012

(Continued)

OTHER PUBLICATIONS

International Search Report issued Jun. 25, 2014 in corresponding International Application No. PCT/AT2014/000059 (with English translation).

(Continued)

*Primary Examiner* — James O Hansen
(74) *Attorney, Agent, or Firm* — Wenderoth, Lind & Ponack, L.L.P.

(57) ABSTRACT

A drive device for a movable furniture part has a lockable ejection device for ejecting the movable furniture part from a closed position into an open position. The ejection device can be unlocked by pressing the movable furniture part into an over-pressed position situated behind the closed position in the closing direction. A blocking element is provided which has a blocking position in which the blocking element prevents the unlocking of the ejection device upon reaching the pressed-over position, and which has a release position in which the ejection device can be unlocked upon reaching the pressed-over position.

23 Claims, 25 Drawing Sheets

(51) Int. Cl.
*A47B 88/40* (2017.01)
*A47B 88/463* (2017.01)
*A47B 88/47* (2017.01)

(58) Field of Classification Search
USPC ..... 312/330.1, 333, 319.1, 319.2
See application file for complete search history.

(56) References Cited

U.S. PATENT DOCUMENTS

| | | | | |
|---|---|---|---|---|
| 6,669,250 | B1 * | 12/2003 | St. Louis | E05C 19/022 292/304 |
| 7,766,407 | B2 | 8/2010 | Nakaya | |
| 7,802,856 | B2 * | 9/2010 | Hashemi | A47B 88/0477 312/319.1 |
| 7,914,093 | B2 | 3/2011 | Huang | |
| 8,109,582 | B2 | 2/2012 | Dubach | |
| 8,186,734 | B2 | 5/2012 | Nakaya | |
| 2006/0290144 | A1 | 12/2006 | Nakaya | |
| 2008/0191592 | A1 | 8/2008 | Dubach | |
| 2011/0000135 | A1 | 1/2011 | Nakaya | |
| 2014/0319986 | A1 | 10/2014 | Brunnmayr | |

FOREIGN PATENT DOCUMENTS

| | | |
|---|---|---|
| CN | 202184423 | 4/2012 |
| CN | 202636179 | 1/2013 |
| DE | 10 2006 056 791 | 6/2007 |
| DE | 10 2010 036 741 | 2/2011 |
| DE | 10 2010 036 902 | 2/2011 |
| DE | 10 2011 002 212 | 10/2012 |
| DE | 20 2011 106 199 | 2/2013 |
| GB | 2 427 651 | 1/2007 |
| JP | 3-153765 | 7/1991 |
| JP | 2004-41616 | 2/2004 |
| JP | 2007-2556 | 1/2007 |
| JP | 2007-190310 | 8/2007 |
| JP | 2009-506847 | 2/2009 |
| WO | 2011/015663 | 2/2011 |

OTHER PUBLICATIONS

Search Report issued Sep. 26, 2016 in corresponding Chinese Application No. 201480020583.2.

* cited by examiner

4=9

B

4=9

SS+B+V

US +B

4=9

SS+V+F

DRIVE DEVICE FOR A MOVABLE FURNITURE PART

BACKGROUND OF THE INVENTION

The invention concerns a drive device for a moveable furniture part, comprising a lockable ejection device for ejecting the moveable furniture part from a closed position into an open position. The ejection device can be unlocked by over-pressing the moveable furniture part into an over-pressing position which is behind the closed position in the closing direction. The invention also concerns an article of furniture having such a drive device. Furthermore, the invention concerns a method of opening and closing a moveable furniture part with a drive device comprising the step of ejection of the moveable furniture part from a closed position into an open position by a lockable ejection device, in which the ejection device is unlocked by over-pressing of the moveable furniture part into an over-pressing position which is behind the closed position in the closing direction.

Drive devices have already been known for many years in the furniture fitting industry, with which, by pressing against a moveable furniture part (for example a drawer), that moveable furniture part is unlocked from the furniture carcass and then the moveable furniture part is opened or actively ejected. For that purpose, such drive devices have a so-called touch latch mechanism. With that mechanism, the movement for closing the drawer from the open position and the movement for unlocking or opening the drawer from the closed position takes place in the same direction, namely in the closing direction. In the case of normal soft closure (manually or by a retraction device), the drawer or the moveable furniture part is held in the closed position at the end of the closing movement by a locking device. If, however, the drawer is excessively firmly pushed shut or the drawer is pressed through until meeting the end abutment (corresponding to the over-pressing position) the ejection device cannot lock at all or is immediately triggered again, whereby it is not possible to guarantee secure closure in the case of such improper operation of the moveable furniture part.

To resolve that problem, a blocking element is known from Austrian patent application A 52/2012 which is of earlier priority but which is not a prior publication, in order to prevent the movement into the over-pressing position in the event of an excessively quick closing movement.

Thus, the over-pressing movement of the moveable furniture part is stopped in the closed position by the blocking element and no over-pressing or pressing beyond the closed position can take place.

SUMMARY OF THE INVENTION

The object of the present invention is to provide an alternative possible way of preventing triggering of the ejection device upon movement beyond the closed position.

Accordingly there is provided a blocking element which has a blocking position in which the blocking element prevents unlocking of the ejection device when the over-pressing position is reached, and which has a release position in which the ejection device can be unlocked when the over-pressing position is reached. That blocking element therefore—in contrast to patent application A 52/2012—provides that the moveable furniture part is not held in the closed position upon being pressed beyond the same, but movement beyond the closed position as far as the end abutment or into the over-pressing position is allowed. More especially, in that way when the moveable furniture part is pressed beyond the closed position, movement of the moveable furniture part into the over-pressing position is admittedly possible but unlocking of the ejection device when the blocking element is in the blocking position is then prevented.

It is possible that the blocking element is already moved into the blocking position in the movement of the moveable furniture part in the opening direction. Preferably, however, it is provided that the blocking element is moveable into the blocking position in the movement of the moveable furniture part in the closing direction. It is important at any event that the blocking element is moveable into the blocking position before the closed position is reached or at the latest when the closed position is reached.

In order also to permit normal triggering of the entire drive device by over-pressing, the blocking element can be moved back from the blocking position into the release position again. Basically, with that return movement of the blocking element from the blocking position into the release position, the moveable furniture part can be disposed in the over-pressing region between the closed position and the over-pressing position. Preferably, however, the moveable furniture part is in the closed position when the blocking element returns to the release position.

For mechanically simple switching over between the blocking position and the release position, the blocking element is moveable from the blocking position into the release position by a resetting device.

In principle, it is possible for the resetting movement to be effected in dependence on the closing pressure or the closing speed. In other words, in the event of forceful or fast movement of the moveable furniture part from the closed position into the over-pressing position, the blocking element can prevent unlocking of the ejection device. As however it may certainly be desirable for the moveable furniture part to be unlocked when the furniture part is firmly pressed shut, it is preferably provided that the resetting movement of the resetting device is effected in time-delayed relationship. In other words, a certain time after reaching the closed position, unlocking of the ejection device is not possible, whereby unlocking is prevented in the event of the moveable furniture part being directly pushed into the over-pressing position. For that purpose, the resetting movement lasts between 0.2 second and 4 seconds, preferably between 0.3 second and 1 second. At least in that period of time therefore no unlocking of the ejection device is possible, after the blocking position or the closed position is reached.

In principle, the lockable ejection device can be designed so that it has a locking pin latchable in a cardioid-shaped guide path. It will be appreciated, however, that a preferred embodiment of the present invention has an ejection lever which is force-actuated by an ejection force storage member, and a locking element which is moveable along a locking base plate and against which the ejection lever bears in the closed position. In the closed position, the locking element which is in a locking position blocks the path of movement of the ejection lever into an ejection portion, and in the over-pressing position the locking element which is in a release position enables the path of movement of the ejection lever into the ejection portion. Therefore, the element which is locked (namely the ejection lever) also at the same time forms the force-actuated component for ejection. Those two components are always provided separately in the case of a touch latch mechanism with a cardioid path.

In principle, it is possible that the blocking element can be provided at any location in the drive device or also separately therefrom. Preferably, however, the blocking element is mounted moveably, preferably rotatably, on the locking element.

To move the blocking element into the blocking position, preferably the blocking element is moveable into the blocking position in a closing movement by the ejection device, preferably by the ejection lever thereof.

Preferably, the blocking element prevents unlocking of the ejection device when the over-pressing position is reached, by the blocking element which is in the blocking position preventing the movement of the locking element into the release position.

The blocking position can preferably be attained by the blocking element being limitedly moveably mounted in a guide path which is preferably provided in the locking base plate, and the blocking element is held, preferably wedged, in its blocking position in the guide path.

To increase the functional scope of the drive device and also to enhance operating comfort and convenience, the drive device can also have a retraction device—preferably formed by the ejection lever. Preferably, that retraction device can also be damped by a damping device. Accordingly, preferably the drive device has a control path. The ejection lever bears against the ejection portion of the control path upon ejection of the moveable furniture part, bears against a stressing portion of the control path upon stressing of the ejection force storage member and bears against a retraction portion of the control path upon retraction of the moveable furniture part into the closed position in the functioning as a retraction device.

An article of furniture has a furniture carcass, a furniture part moveable in the furniture carcass, and a drive device as described above.

For a method of opening and closing a moveable furniture part with a drive device, the object according to the invention is attained by movement of a blocking element of the drive device upon closing of the moveable furniture part into a blocking position in which unlocking of the ejection device is prevented upon reaching the over-pressing position, and movement of the blocking element from the blocking position into a release position in which unlocking of the ejection device occurs upon reaching the over-pressing position. Preferably, the movement of the blocking element from the blocking position into the release position is effected, with the moveable furniture part in the closed position, in time-delayed relationship, by a resetting device, preferably in a time of between 0.2 and 4 seconds.

BRIEF DESCRIPTION OF THE DRAWINGS

Further details and advantages of the present invention will be described more fully hereinafter by means of the specific description with reference to the embodiments by way of example illustrated in the drawings, in which.

DETAILED DESCRIPTION OF THE INVENTION

Figure 1:
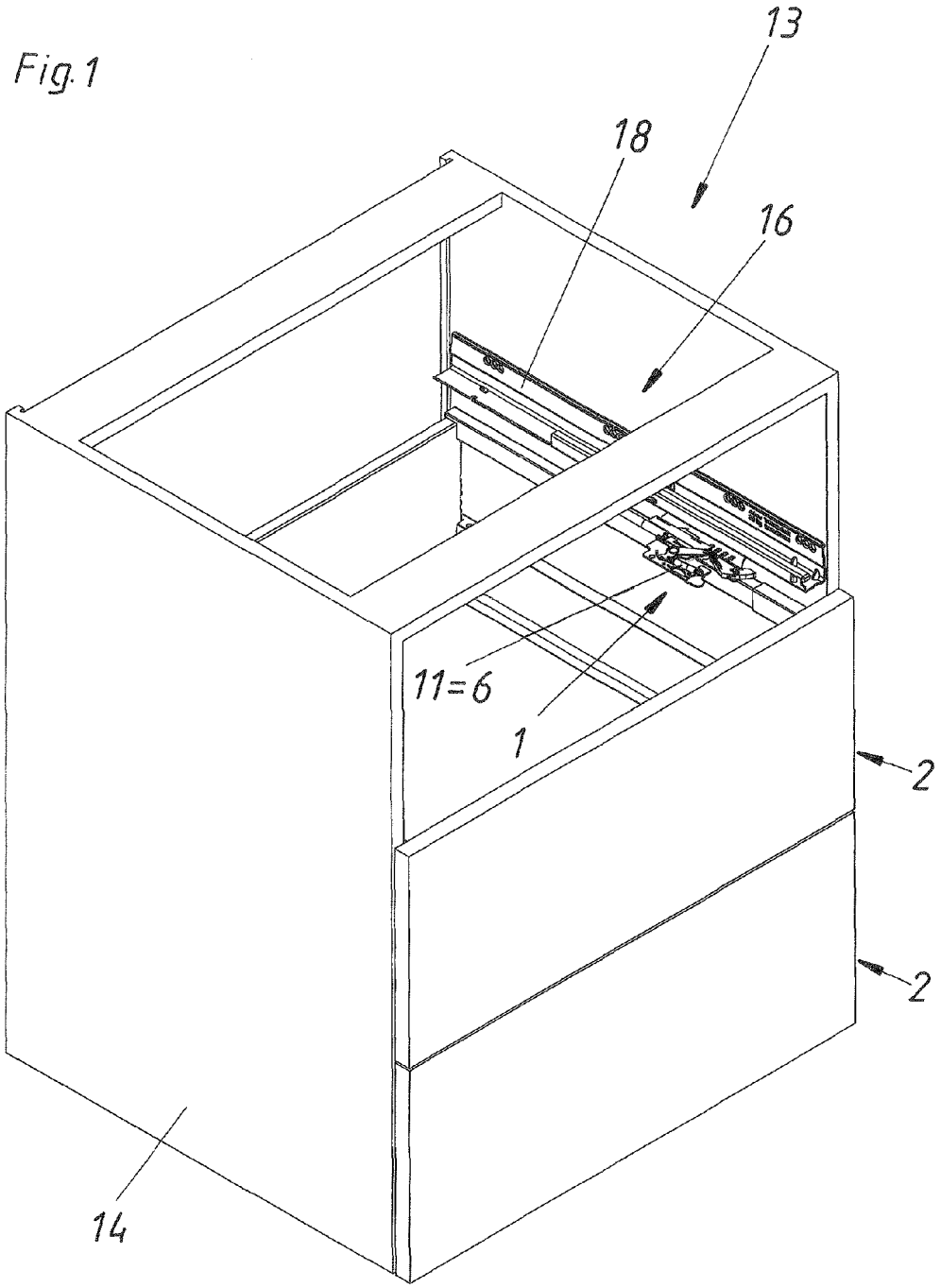
FIG. 1 shows an article of furniture with an extension guide device and a drive device.

FIG. 1 shows an article of furniture 13 comprising a furniture carcass 14 and furniture parts 2 mounted moveably therein. Those moveable furniture parts 2 in the form of drawers are linearly displaceably supported by an extension guide device 16 on the furniture carcass 14. The extension guide device 16 has a carcass rail 18, a drawer rail (not shown here) and possibly a central rail. The drive device 1 is fixed to the extension guide device 16 or the moveable furniture part 2.

Figure 2A:
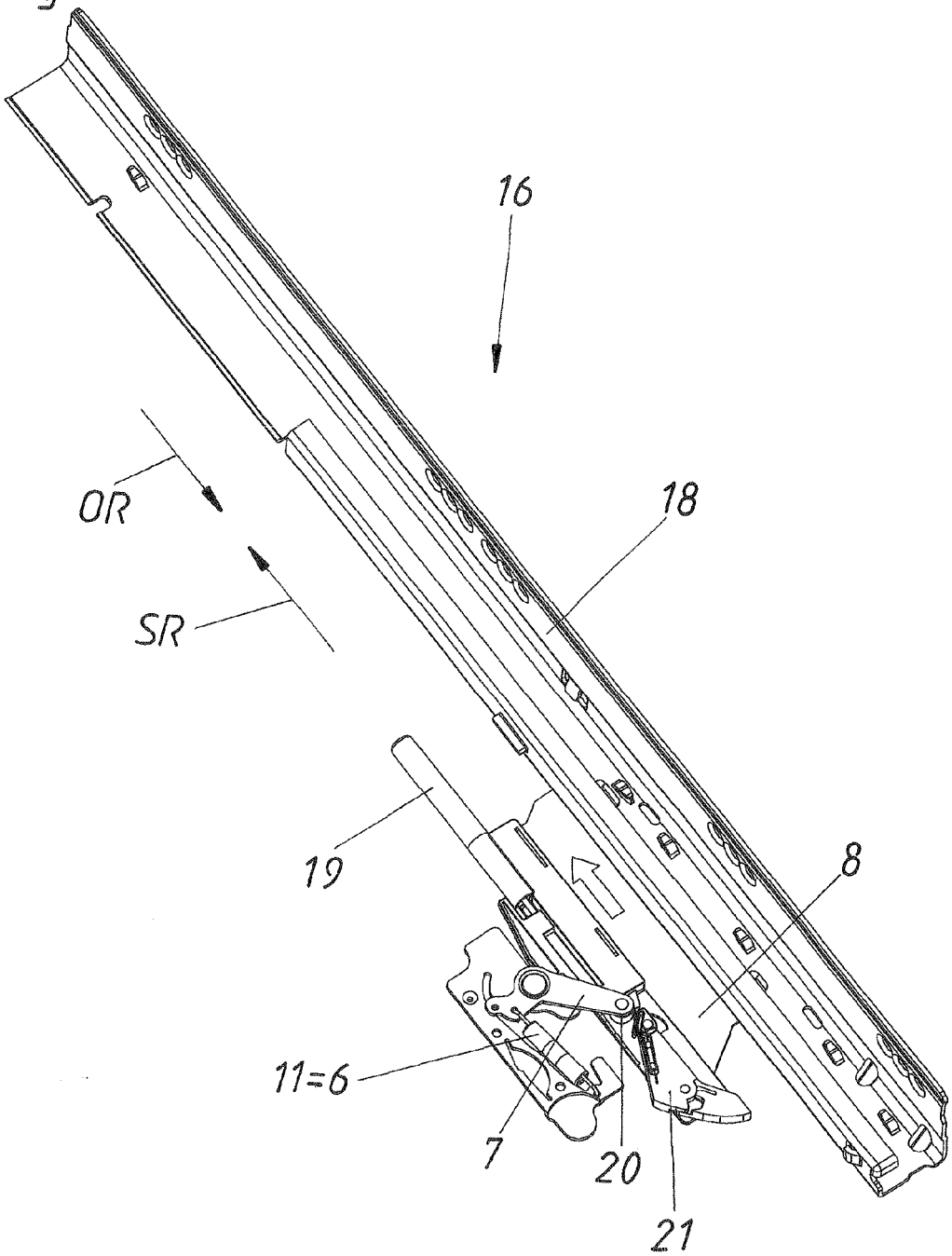
FIG. 2*a* shows the extension guide device with the drive device.

In that respect, it can be seen from FIG. 2*a* that the drive device as essential components has an ejection lever 7 and the ejection force storage member 6 which at the same time serves as a retraction force storage member 11. There is also a damping device 19.

Figure 2B:
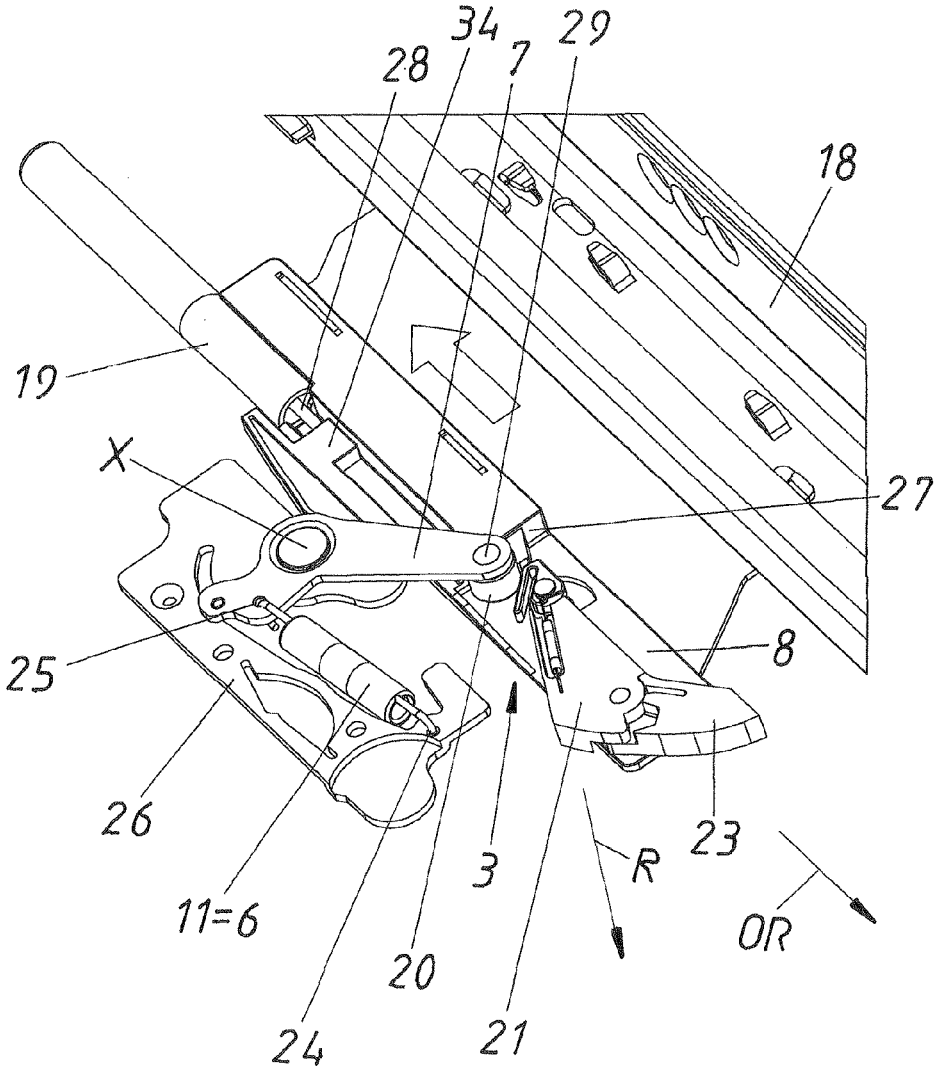
FIG. 2*b* shows a detail from FIG. 2*a*, FIGS. 3*a* through 3*c* show the drive device in a closed position.

It can be seen in detail from FIG. 2*b* that the ejection lever 7 bears against the ejection abutment 27 by way of the ejection roller 20. The ejection roller 20 is mounted rotatably to the ejection lever 7 by way of the rotary bearing 29. In principle, the ejection lever is mounted to the ejection base plate 26 rotatably about the pivot axis X. In this embodiment, the ejection base plate 26 is mounted to a drawer bottom underside of the moveable furniture part 2. The ejection force storage member 6 is fixed by way of the first spring base 24 to the ejection base plate 26 and by way of the first spring base 25 to the ejection lever 27. The ejection force storage member 6 is in the form of a tension spring. In contrast to the ejection base plate 26, the locking base plate 8 is mounted to the carcass rail 18. The ejection abutment 27 is arranged on that locking base plate 8. In addition, the control element 21 is mounted moveably in the release direction R on the locking base plate 8. The control element 21 is acted upon by a force in the release direction R by a force storage member (not shown here). In addition a force-actuated flap 23 is rotatably mounted to the control element 21. The damping device 19 has a damping piston 28, the damping piston 28 bearing against the slider 34. The slider 34 bears against the ejection lever 7 in particular shortly before reaching the closed position SS and damps the retraction movement of the ejection force storage member 6 which operates as the retraction force storage member 11. For movement of the moveable furniture part 2 in the opening direction OR, the moveable furniture part 2 bears against the ejection abutment 27 formed or arranged on the furniture carcass 14, by way of the ejection lever 7 arranged on the moveable furniture part 2.

Figure 3A:
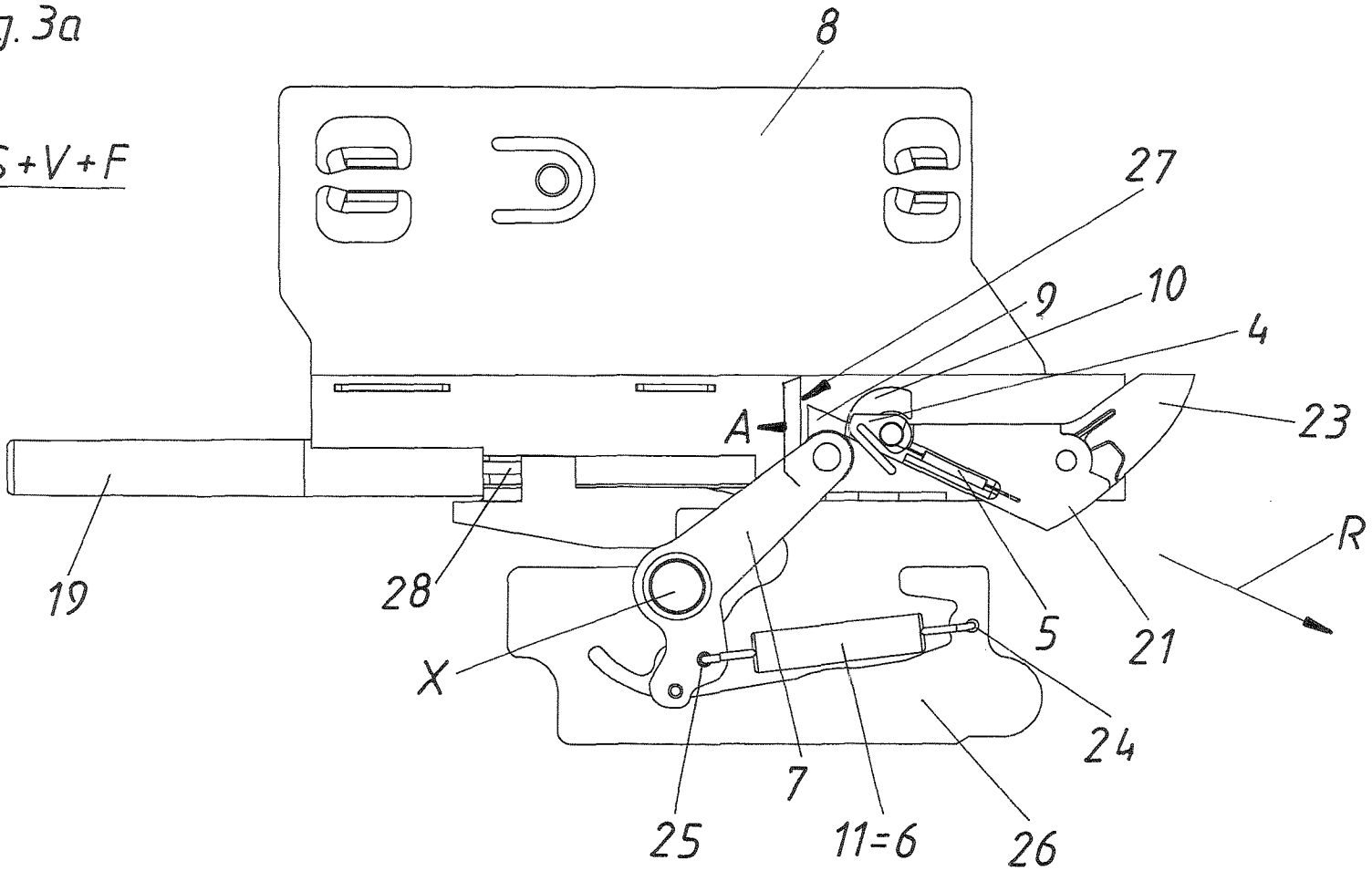
Figure 3C:
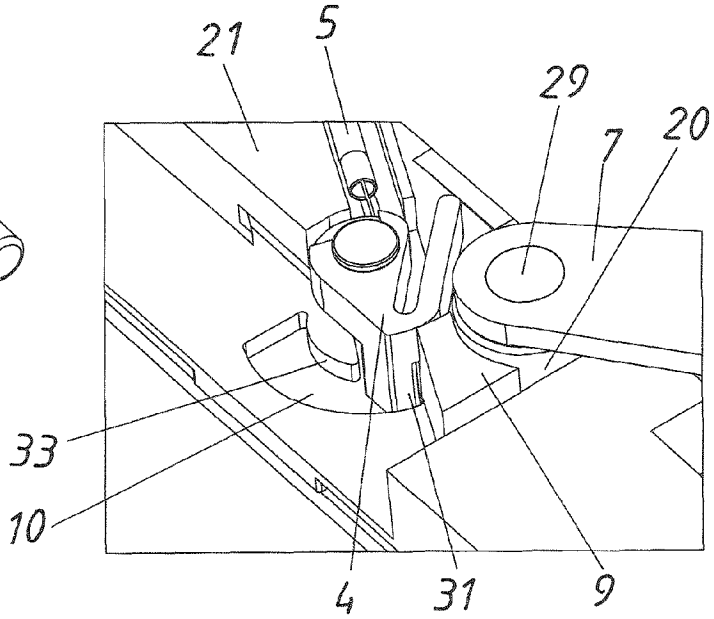
Figure 3B:
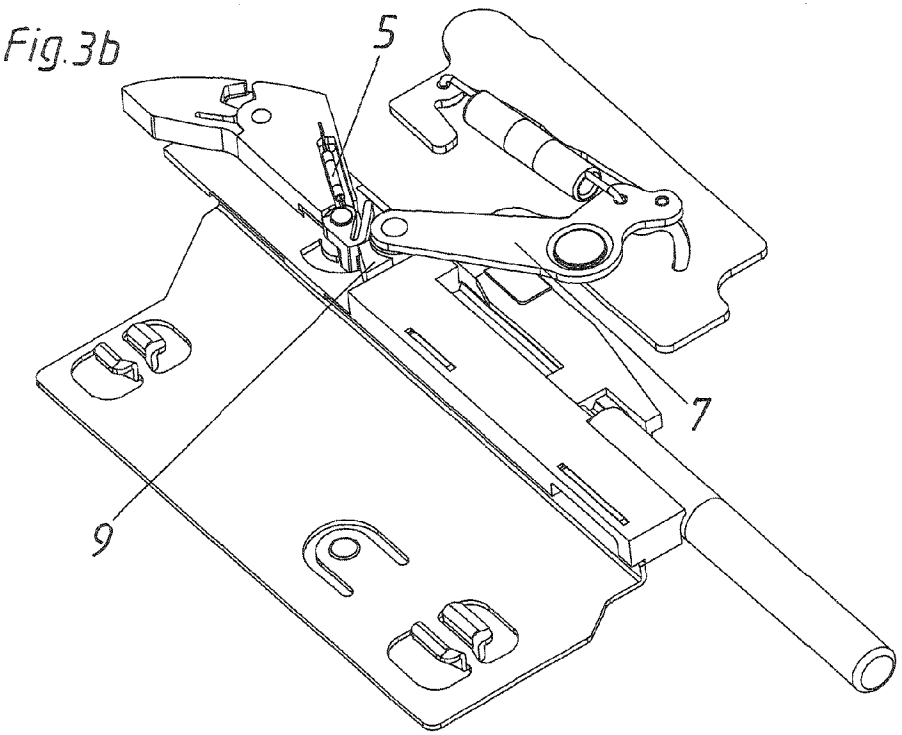

FIGS. 3*a* through 3*c* show various views of the drive device 1, that position of the drive device 1 corresponding to the closed position SS of the moveable furniture part 2. It will further be seen that the blocking element 4 mounted rotatably to the control element 21 is in a release position F. The locking element 9 which in FIGS. 3*a* through 3*c* is in the locking position V is connected to the control element 21 or is provided in one piece therewith. In that locking position V, the ejection lever 7 bears against the locking element 9 by way of the ejection roller 20. The force storage member (not shown) which is operative between the locking base plate 8 and the control element 21 admittedly seeks to move the locking element 9 in the release direction R, but that is prevented by the ejection lever 7 bearing against the locking lever 9 as the force of the ejection force storage member 6 is greater than that of the force storage member (not shown) between the locking element 9 or the control element 21 and the locking base plate 8.

Figure 4B:
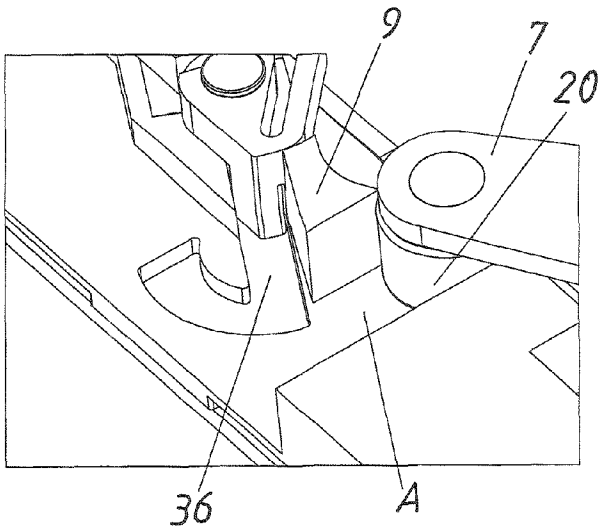
FIGS. 4*a* and 4*b* show the drive device upon over-pressing.
Figure 4A:
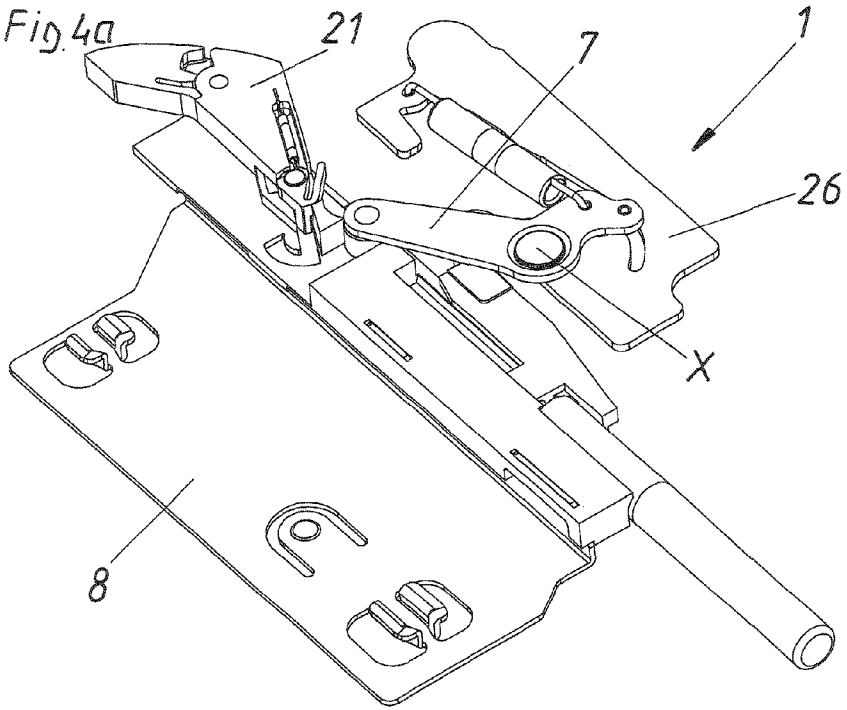

When now pressure is applied to the moveable furniture part 2 in the closing direction SR, the moveable furniture part 2 passes into the over-pressing position ÜS, in which case then the drive device 1 is in the position shown in FIGS. 4*a* and 4*b*. The ejection base plate 26 also moves relative to the locking base plate 8 by virtue of the movement of the moveable furniture part 2 in the closing direction. However, in accordance with the closed position SS, the ejection roller 20 of the ejection lever 7 already bears in the closed position SS against the ejection abutment 27. Thereforem, the ejection roller 20 cannot move further in the closing direction SR when the moveable furniture part 2 moves into the over-pressing position ÜS, but a pivotal movement of the ejection lever 7 about the pivot axis X is triggered. Admittedly, by virtue of that pivotal movement, the ejection roller 20 remains in the same position, as viewed in the closing direction SR, but the situation involves a movement of the ejection roller 20 transversely relative to the closing direction SR or the opening direction OR. As a result, the ejection roller 20 is moved away from and brought out of contact with the locking element 9 until the control element 21 together with the locking element 9 can move past the ejection roller 20 into the release direction R, by virtue of the force storage member (not shown). Accordingly, the locking element 9 moves out of the locking position V into the release position G whereby the ejection lever 7 is no longer held to the locking element 9, and so the path of movement into the ejection portion A is free.

Figure 5A:
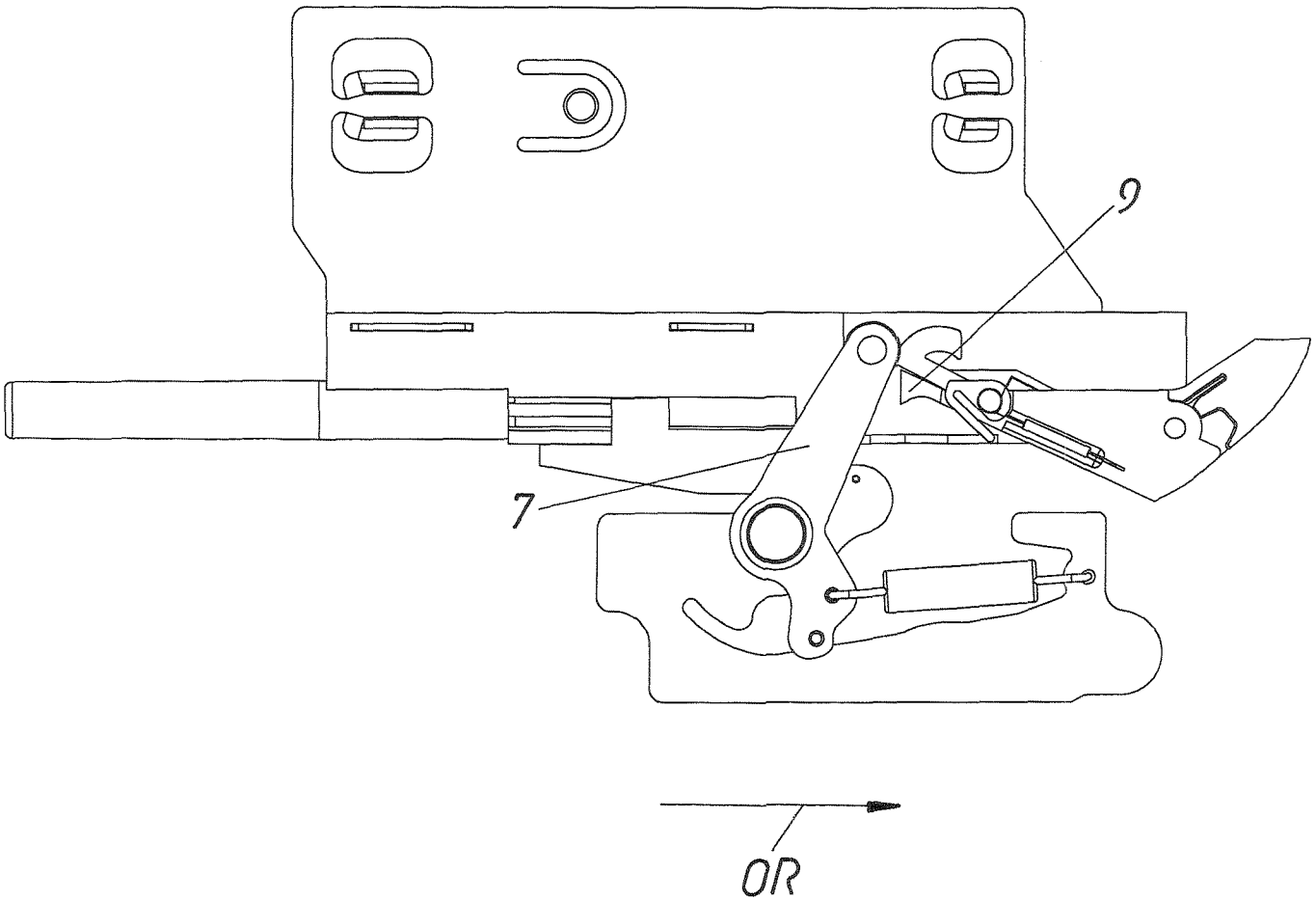
FIGS. 5*a* through 7 show the drive device upon ejection.
Figure 5B:
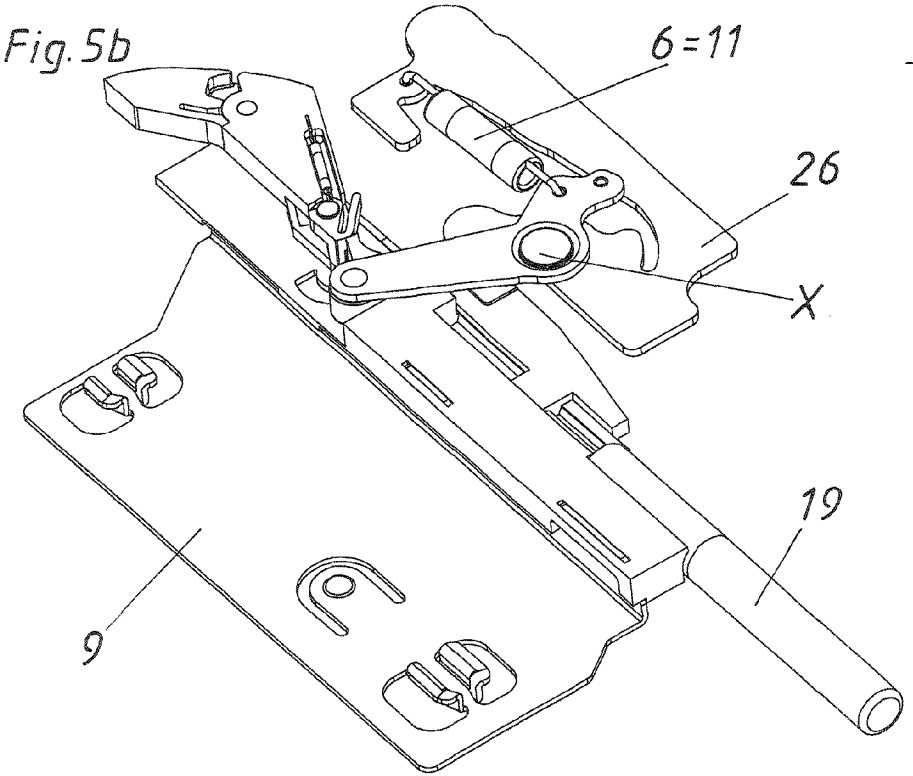
Figure 5C:
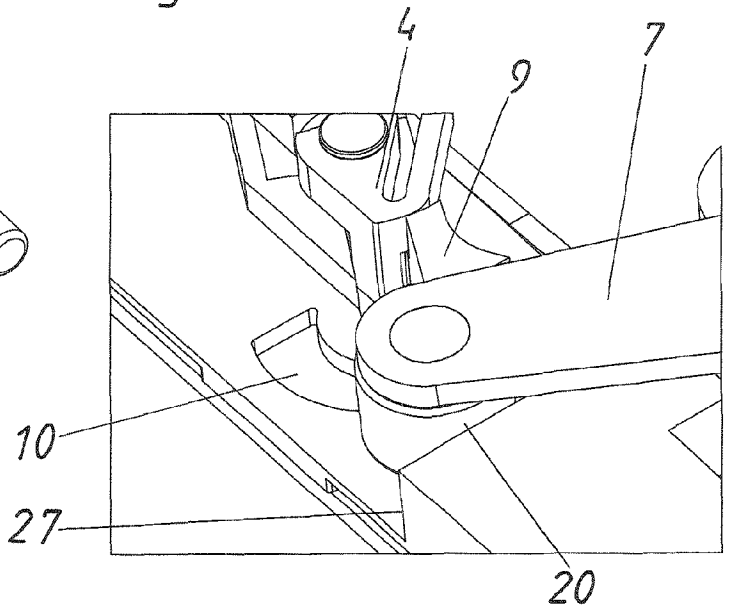

As soon as that ejection portion A is no longer locked by the locking element 9 the ejection force storage means 6 can be relieved and pivots the ejection lever 7 in the counter-clockwise direction into the position in FIGS. 5*a* through 5*c*. With that pivotal movement the ejection lever 7 comes to bear by way of the ejection roller 20 against the ejection abutment 27 of the ejection base plate 26 and moves the moveable furniture part 2 relative to the furniture carcass 4 in the opening direction OR. Accordingly the moveable furniture part 2 is disposed in an open position OS as shown in FIGS. 5*a* through 5*c*. The locking element 9 is still in the release position G.

Figure 6:
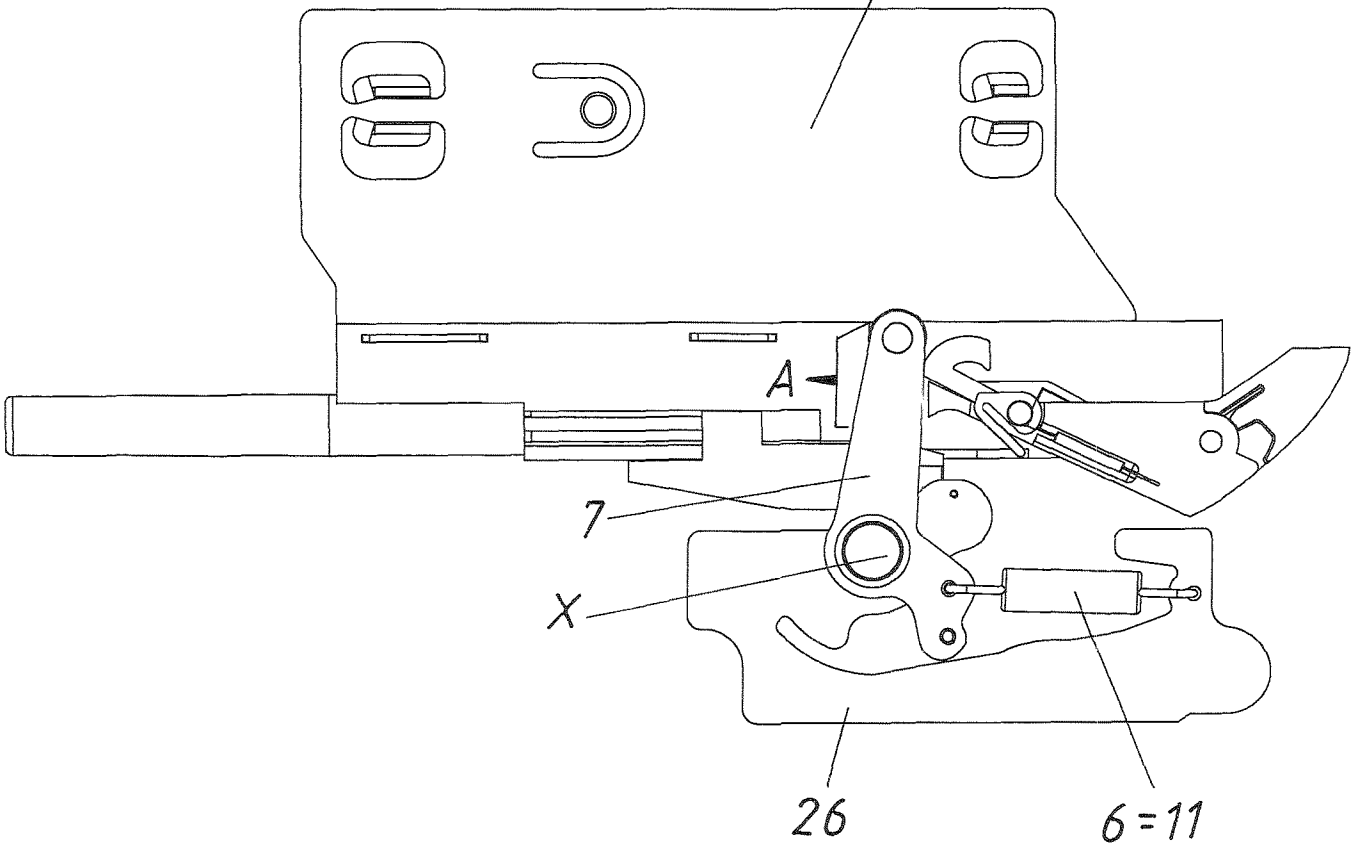
Figure 7:
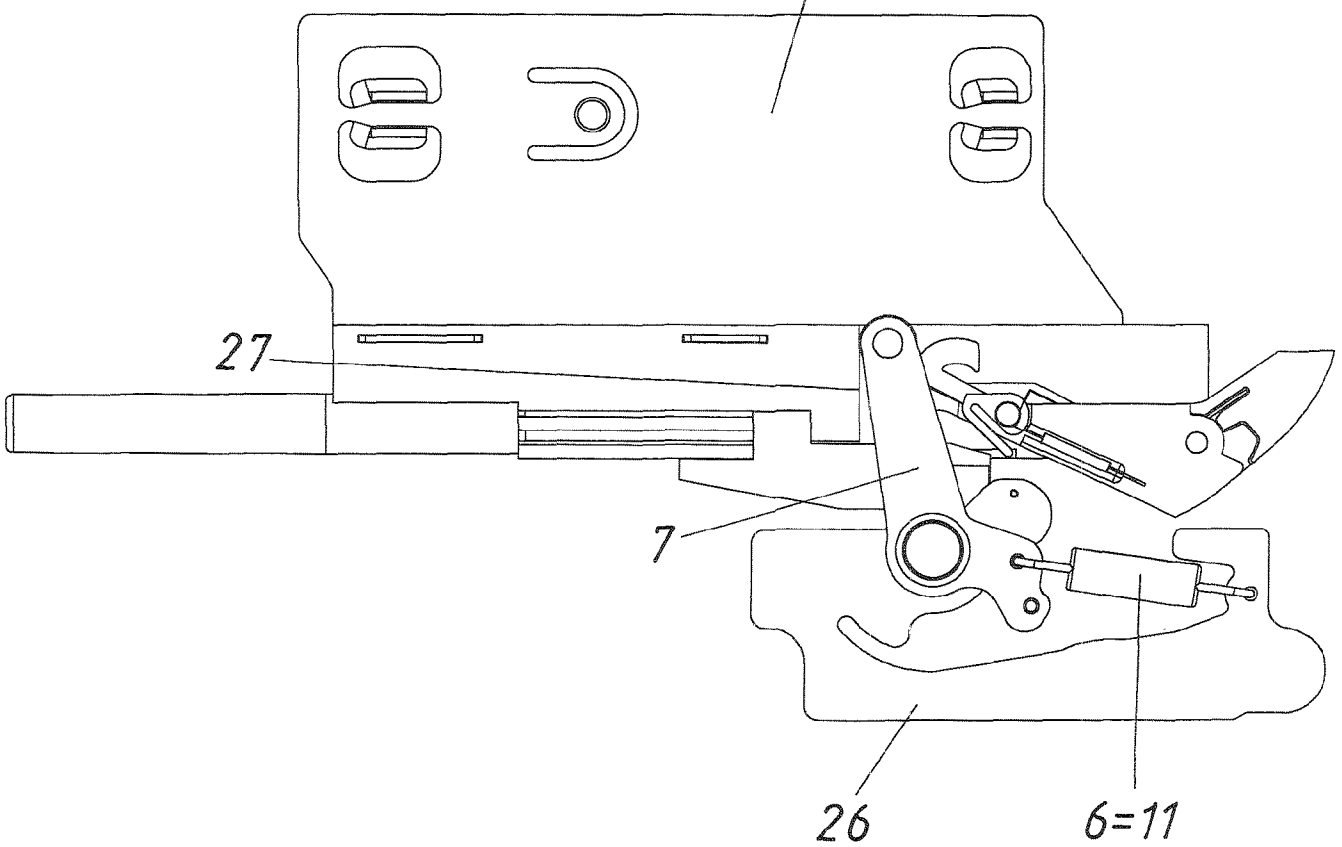

Because the ejection force storage member 6 is further relieved, the drive device 1 moves further into the positions shown in FIGS. 6 and 7.

Figure 8:
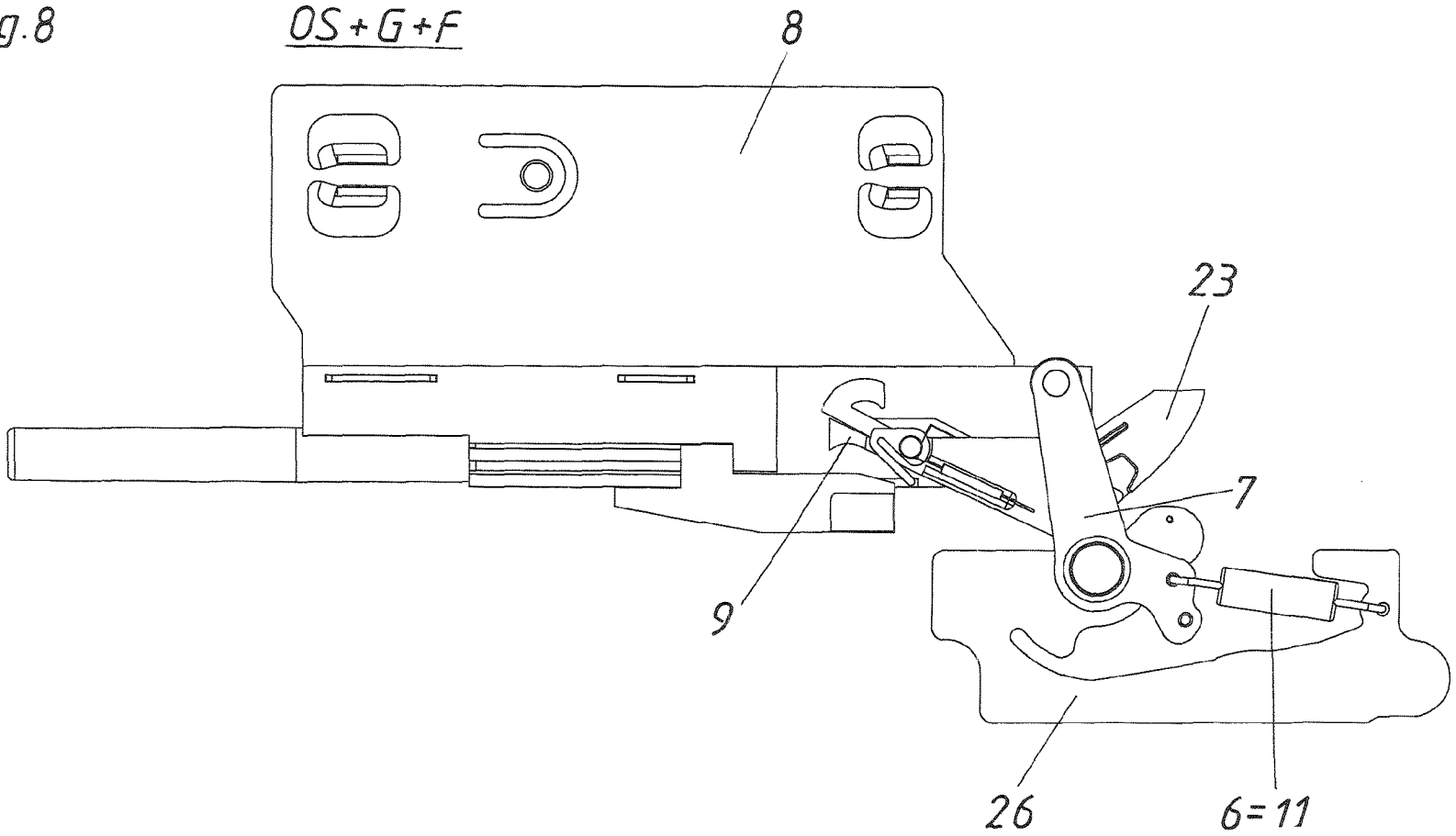
FIG. 8 shows the drive device in the free-running condition.

The drive device moves further into the position shown in FIG. 8 by the inertia of the ejection device 3 or by manually pulling on the moveable furniture part 2 in the opening direction OR. In that position, the moveable furniture part 2 is in a free-running condition. When the moveable furniture part 2 is moved from FIG. 8 further in the opening direction OR, the flap 23 allows the ejection roller 20 to pass, with a pivotal movement in the clockwise direction.

Figure 9:
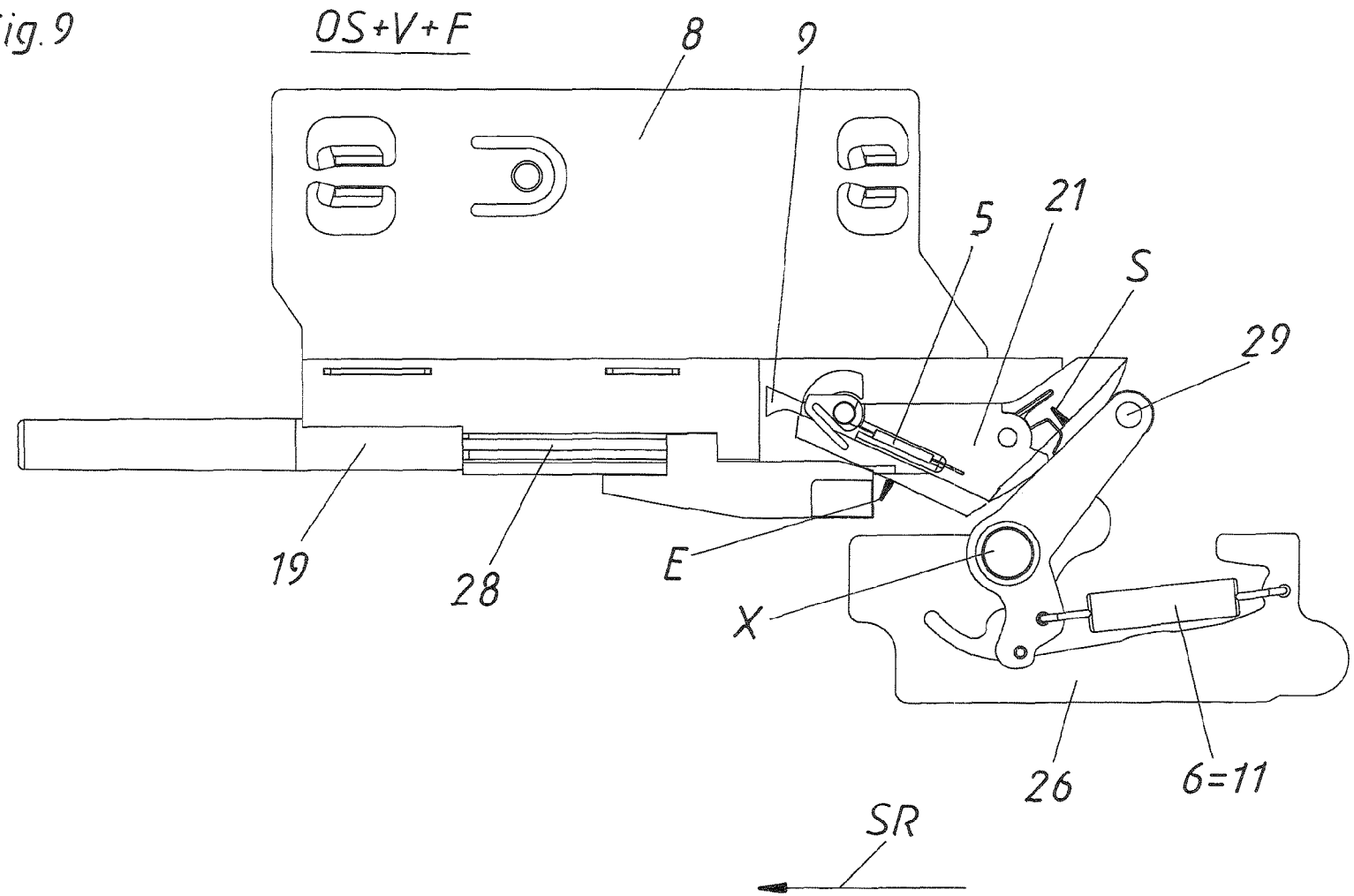
FIG. 9 shows the drive device upon stressing.

When the moveable furniture part 2 is then moved again in the closing direction SR, the ejection roller 20 comes into contact with the stressing portion S provided on the flap 23 and the control element 21 (see FIG. 9). As soon as the ejection roller 20 contacts the control element 21 or the flap 23, the entire control element is moved against the force of the force storage means (not shown) in opposite relationship to the release direction R whereby the locking element 9 passes into the locking position V.

Figure 10:
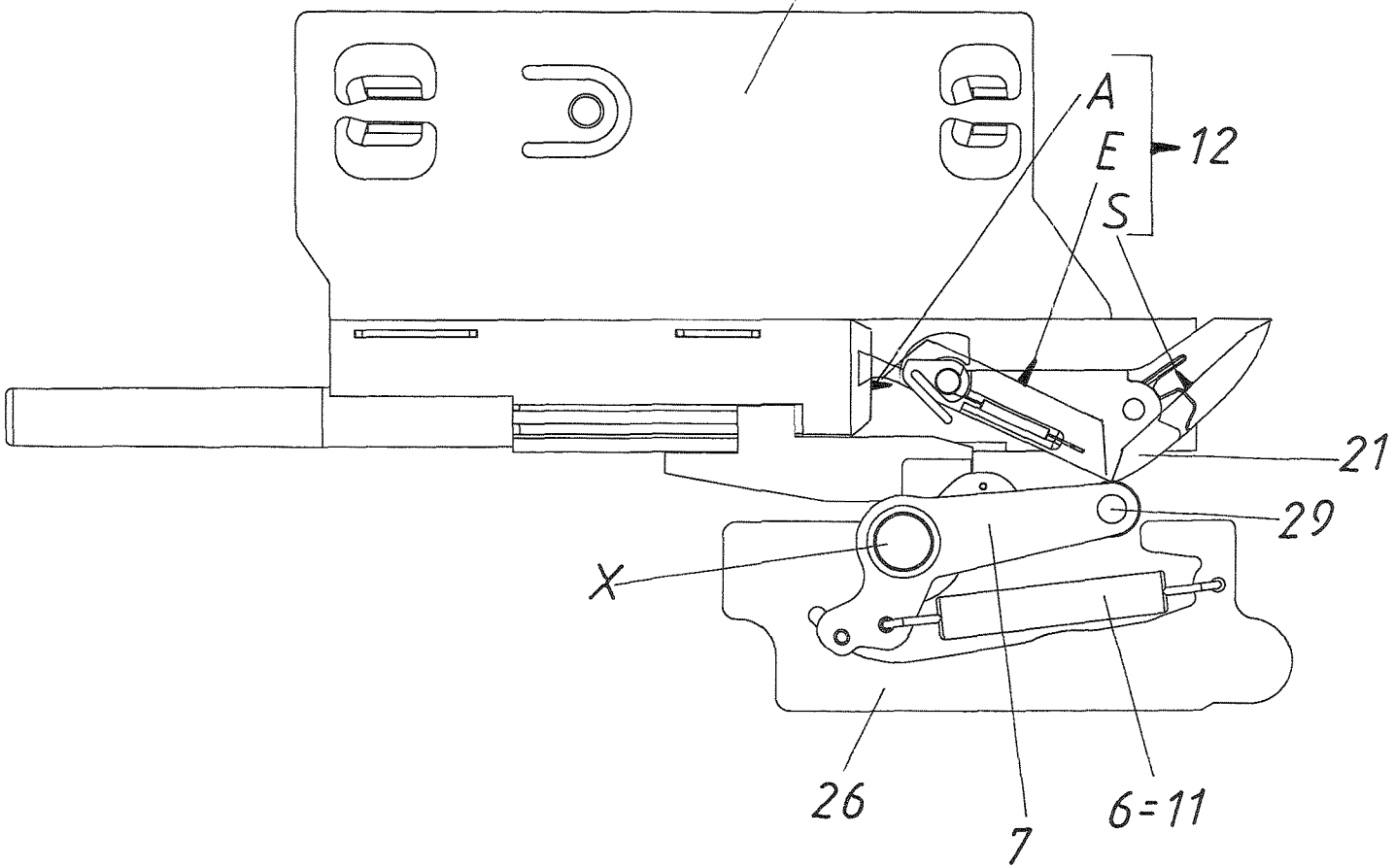
FIG. 10 shows the drive device with the force storage member fully stressed.

Upon further movement of the moveable furniture part 2 in the closing direction SR, the ejection roller 20 is displaced or rolls along the stressing portion S to the position shown in FIG. 10 in which the ejection force storage member 6 is fully stressed. The stressing portion S with the retraction portion E and the ejection portion A form the essential components of the control path 12.

Figure 11:
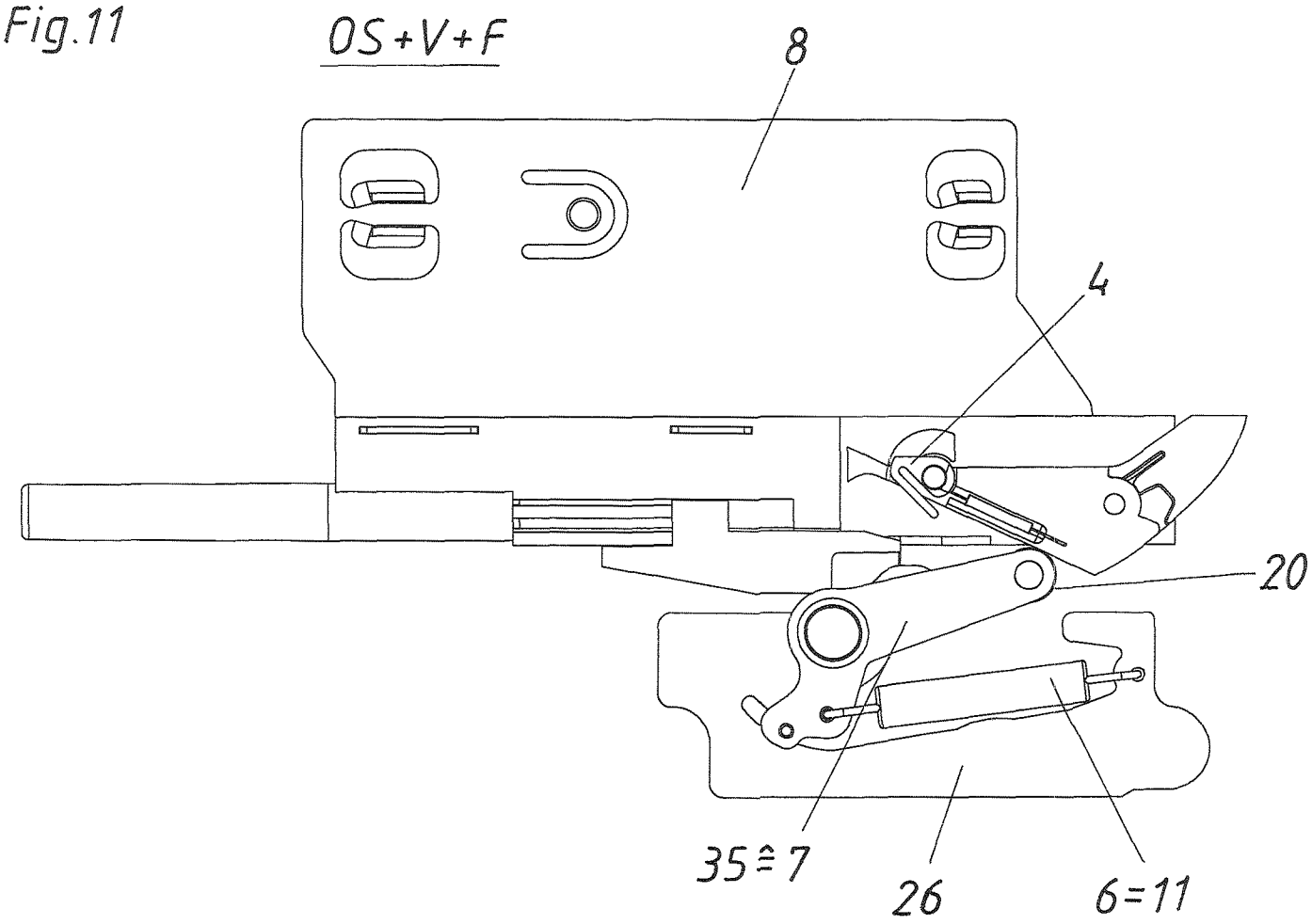
FIG. 11 shows the drive device upon ejection.

After moving beyond the position shown in FIG. 10 in the closing direction SR, the ejection lever 7 moves into the retraction portion E as shown in FIG. 11, in which case the ejection lever 7 now operates as a retraction device 35, in cooperation with the retraction force storage member 11. By virtue of the mechanical contact between the ejection roller 20 and the control element 21, the control element 21 is further pushed in opposite relationship to the release direction R so that the locking element 9 remains in the locking position V.

Figure 12A:
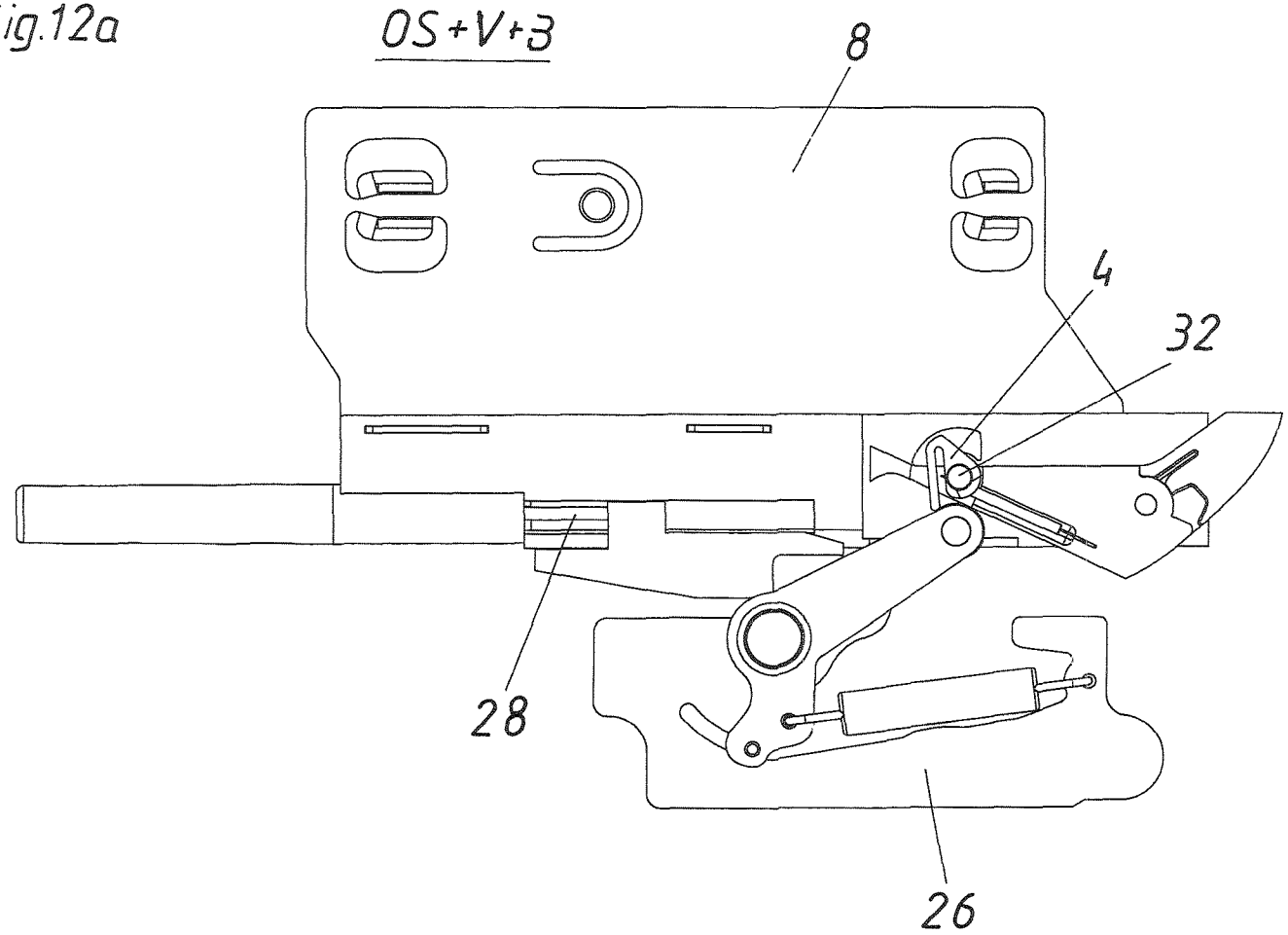
FIGS. 12*a* through 13*c* show the drive device upon movement of the blocking element into the blocking position.
Figure 12C:
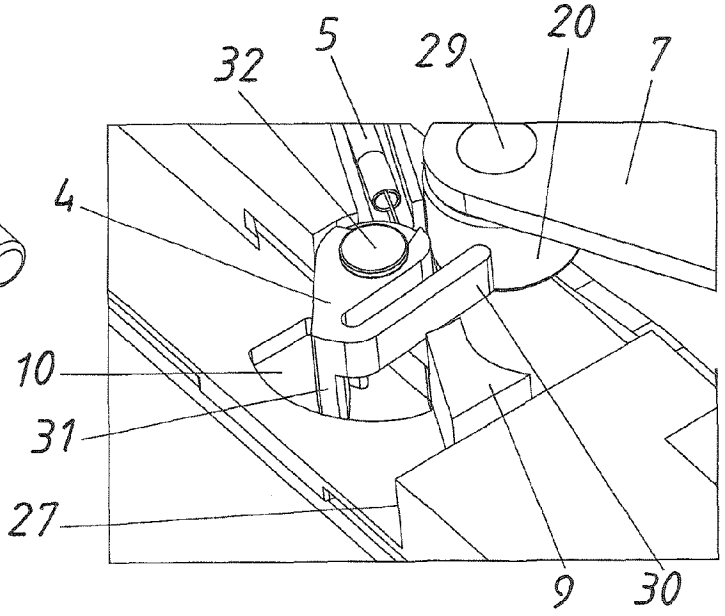
Figure 12B:
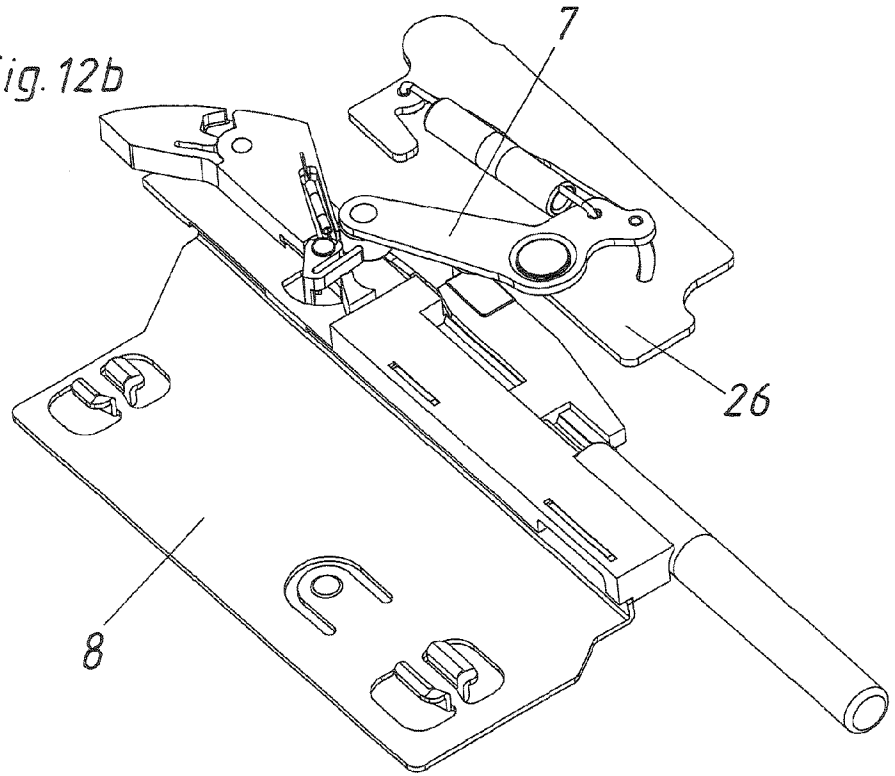

As a further consequence the ejection roller 20 comes into contact with the rotary lever 30 of the blocking element 4, as shown in FIGS. 12*a* through 12*c*. By virtue of that contact the blocking element 4 is rotated in the clockwise direction about the rotary bearing 32. As a result, the blocking cam 31 is also displaced in the guide path in the locking base plate 8. Simultaneously with that rotary movement, the resetting device 5 which is in the form of a tension spring is also stressed. That tension spring is fixed on the one hand to the control element 21 and on the other hand to the blocking element 4. As shown in FIGS. 12*a* through 12*c* the blocking element 4 is thus already in the blocking position B.

Figure 13A:
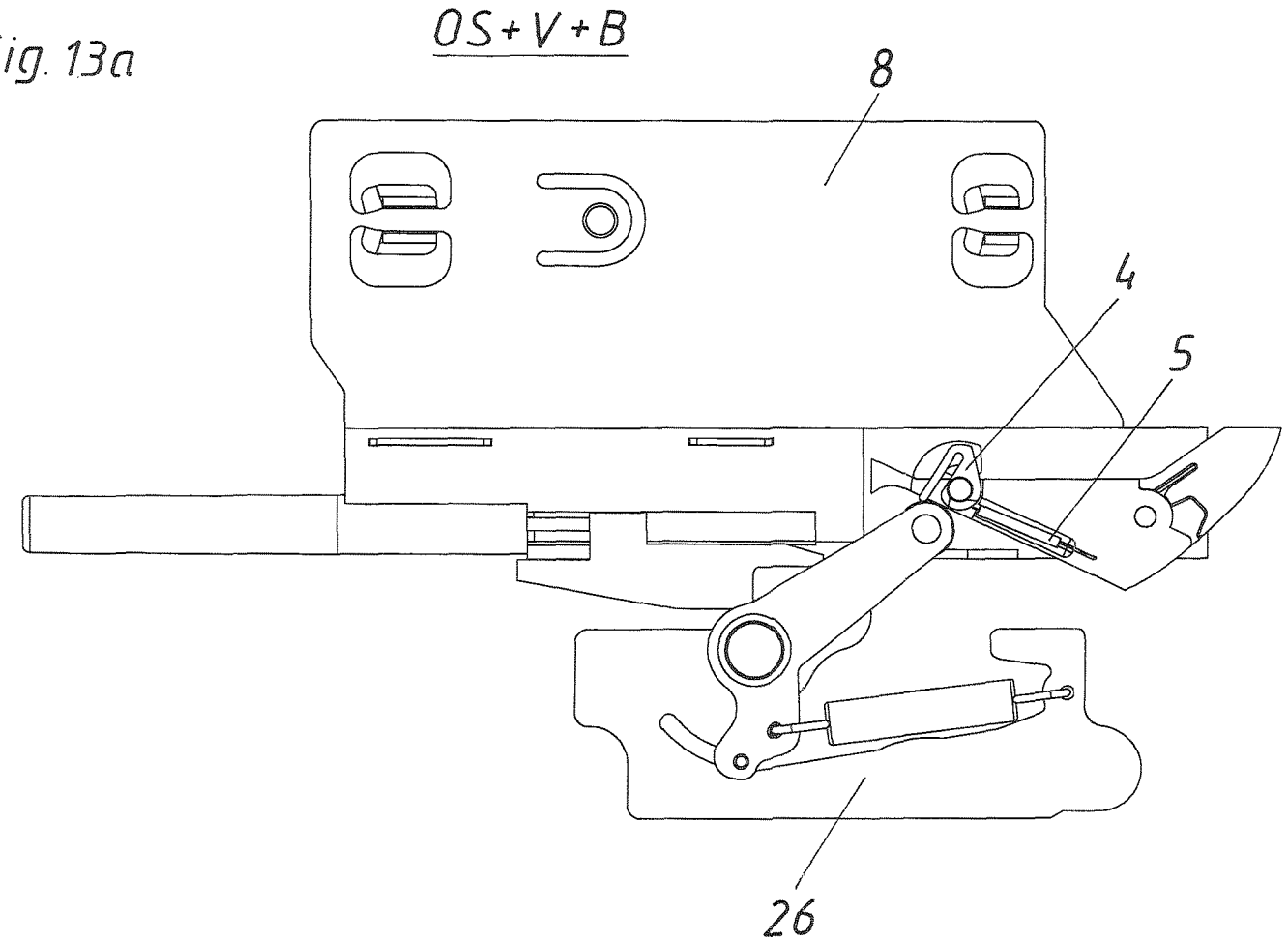
Figure 13C:
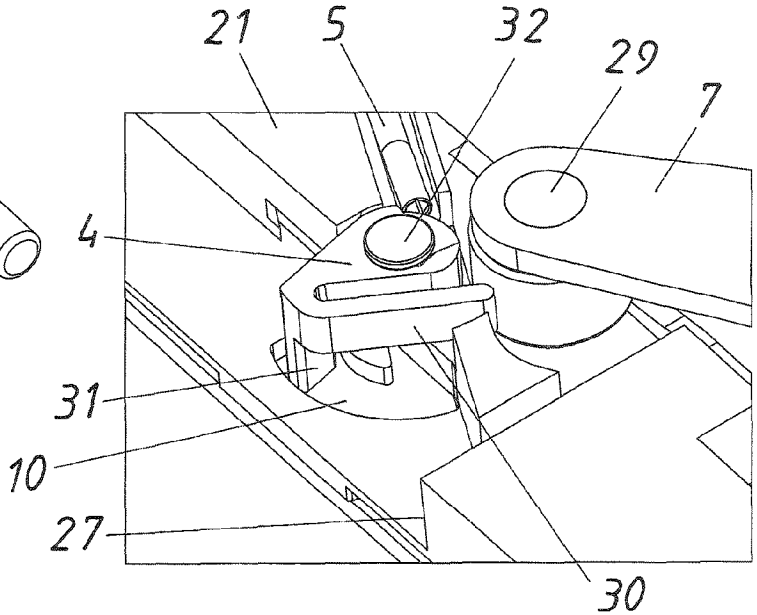
Figure 13B:
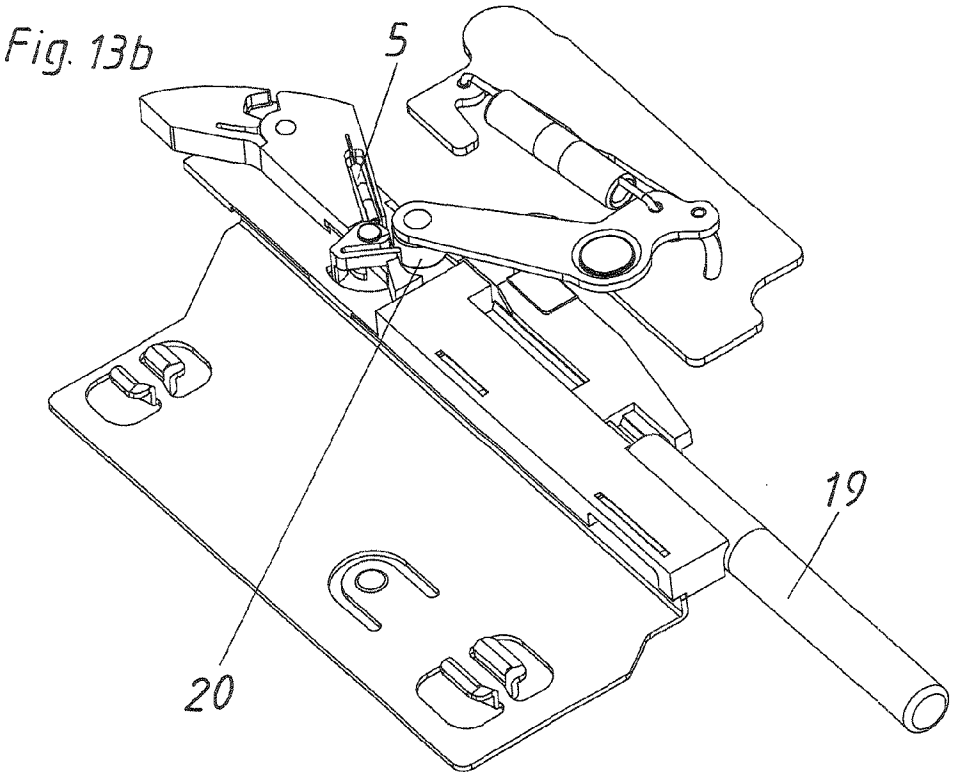

By virtue of the relief of the retraction force storage member 11, the drive device 1 moves further into the position shown in FIGS. 13*a* through 13*c* in which the moveable furniture part 2 is still in an open position OS. During that retraction movement, the effect of the damping device 19 also takes place and opposes the spring force of the retraction force storage member 11. As shown in FIGS. 13*a* through 13*c* the blocking element has rotated further in clockwise direction so that the blocking cam 31 reaches the end of the guide path 10. The resetting device 5 is fully loaded in that position.

Figure 14:
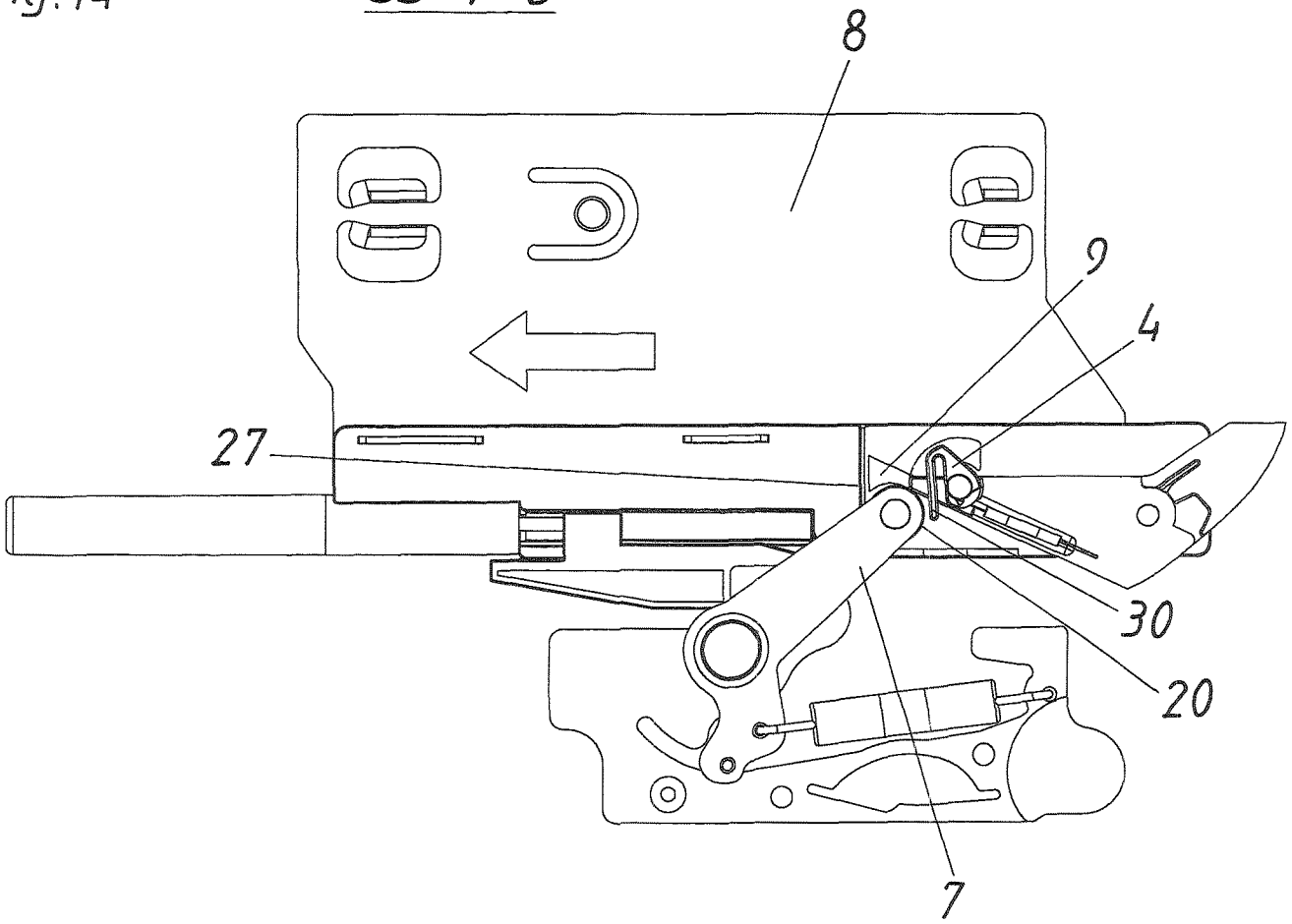
FIG. 14 shows the drive device upon reaching the closed position.
Figure 15B:
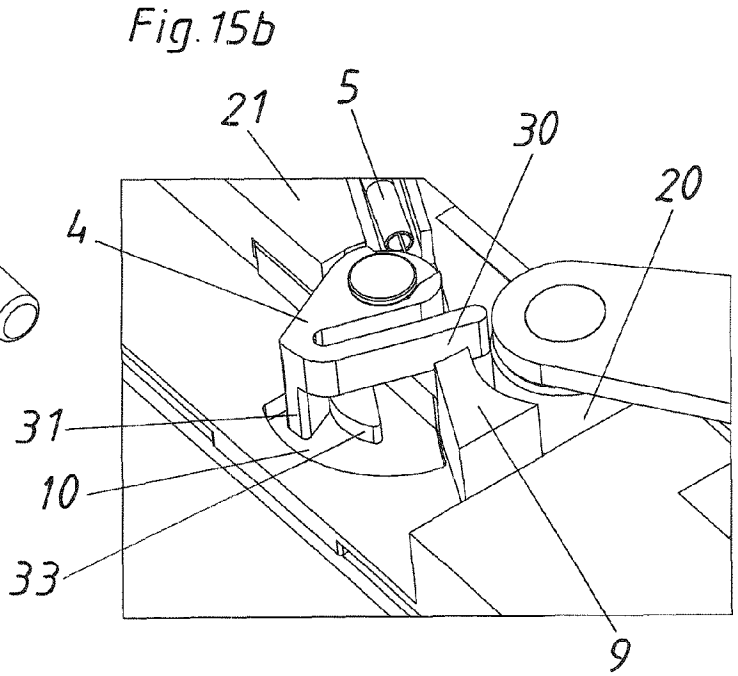
FIGS. 15*a* through 15*b* show the drive device upon unlocking being prevented by the blocking element.

Soon after the ejection roller 20 is no longer in contact with the rotary lever 30, the ejection roller 20 and the ejection lever 7 pass into a position shown in FIG. 14 corresponding to the closed position SS of the moveable furniture part 2. In that case, the ejection roller 20 bears against the locking element 9. The blocking element 4 is admittedly no longer contacted by the ejection roller 20 but nonetheless it is still in the blocking position B, but it has already covered a part of the resetting movement T by virtue of the resetting device 5. That resetting movement T is however time-delayed by a delay device. That delay device can be, for example, in the form of a rotational damper in the rotary bearing 32. That delay device provides that the movement of the blocking element 4 from the blocking position B into the release position F lasts between 0.2 second and 4 seconds. The ejection device 3 cannot be unlocked during that period, which is illustrated by FIGS. 15*a* through 15*b* which are described hereinafter.

Figure 15A:
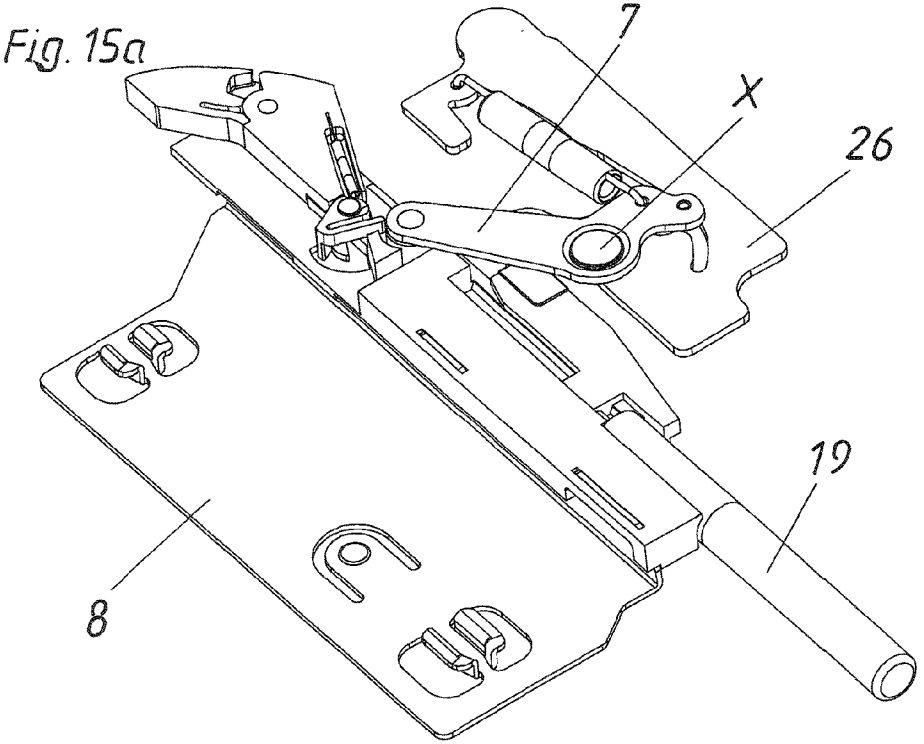

Particularly by a comparison with FIG. 4*a*, it can be seen more specifically in FIG. 15*a* that the ejection lever 7 has rotated in the clockwise direction about the pivot axis X again by virtue of the movement of the moveable furniture part 2 into the over-pressing position ÜS. As a result, the ejection roller 20 moves away from the locking element 9, whereby that locking element 9 actually seeks (is urged) to move in the release direction R by way of the control element 21 by virtue of the force storage member (not shown). It will be noted, however, that that movement in the release direction is prevented as shown in FIG. 15*b* by the blocking cam 31 of the blocking element 4 bearing against the blocking flank 33 of the guide path 10 in the locking base plate 8. Thus, at most a slight movement of the locking element 9 in the release direction R is possible, but it is not sufficient to release the ejection portion A for the ejection lever 20. Thus, upon over-pressing of the moveable furniture part 2 into the over-pressing position ÜS, as long as the blocking element 4 is in the blocking position, the ejection device 3 cannot be unlocked. As long as pressure is still applied to the drawer (moveable furniture part) which is in the over-pressing position ÜS by an operator, the blocking element 4 cannot be moved into the release position F by the resetting device 5. That is because the ejection roller 20 does not bear against the locking element 9 "fully"—as is the case in the closed position SS—but the locking element 9, by virtue of the force storage member (not shown), is displaced with respect to the closed position SS by a short distance in the release direction R. By virtue of that displacement, the axis of rotation of the rotary bearing 32 no longer coincides with the configuration of the guide path 10 and the blocking cam 31 cannot move along the guide path 10 in the counter-clockwise direction but is wedged against the blocking flank 33 (see FIG. 15*b*). This means that, as long as an operator is pressing against the moveable furniture part 2 when in the over-pressing position ÜS no movement of the blocking element 4 into the release position F can take place.

It is only when the moveable furniture part 2 is released that the ejection force storage member 6 can be relieved somewhat again and pivot the ejection lever 7 in the counter-clockwise direction so that the locking element 9 moves into the position shown in FIG. 14 again by way of the ejection roller 20. In that FIG. 14 position, the axis of rotation of the rotary bearing 32 again coincides with the radius of the guide path 10 so that the resetting device 5 can move the blocking element 4 in the counter-clockwise direction in time-delayed relationship into the release position F shown in FIG. 3*c*. In that FIG. 3*c*, the blocking cam 31 has overcome the blocking flank 33 and the blocking element 4, when the moveable furniture part 2 is over-pressed into the over-pressing position ÜS, can also be moved along the straight portion 36 of the guide path 10 with the control element 21 and the locking element 9 in the release direction R so that, as shown in FIG. 4*b*, the ejection portion A is cleared for the ejection roller 20.

Figure 16:
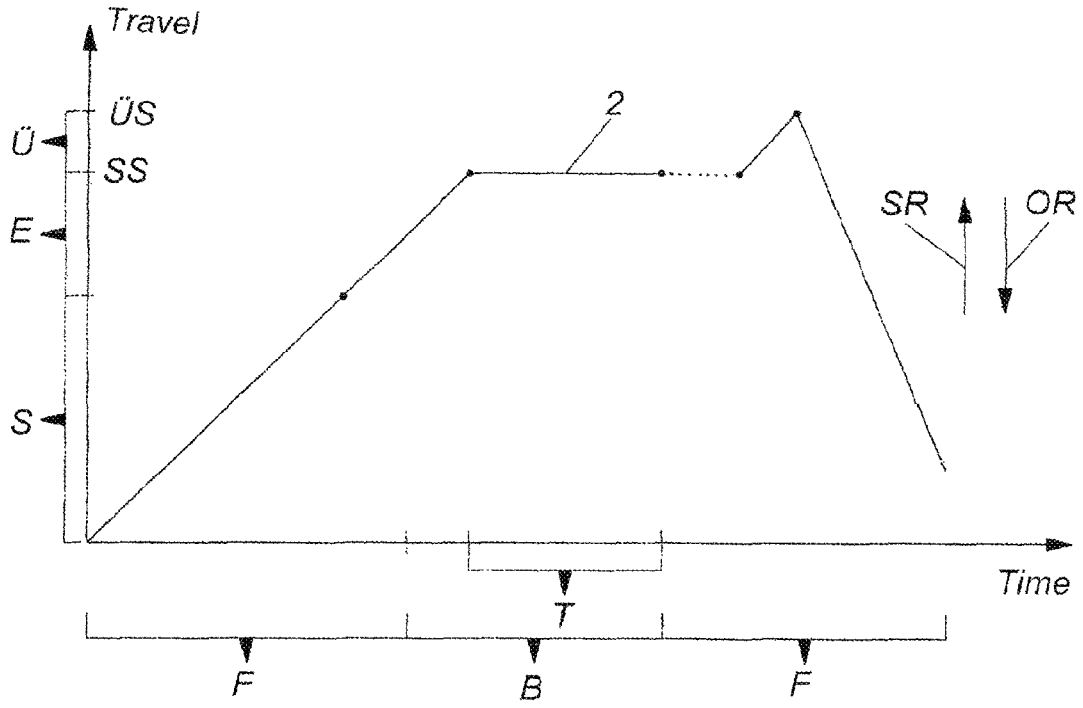
FIG. 16 shows a time-travel graph for the movement of the moveable furniture part in normal closing and triggering.

FIG. 16 diagrammatically shows a time-travel graph illustrating the position of the moveable furniture part 2 during a closing operation without being pushed beyond the closed position. At the beginning of the closing movement, accordingly, the blocking element 4 is still in the release position F. At the same time, the drive device 1 is moved along the stressing travel distance S and then reaches the retraction portion E. During the movement of the moveable furniture part 2 in the retraction portion E, the blocking element 4 is moved from the release position F into the blocking position B or switched over. When the closed position SS is reached, the blocking element 4 is also in the blocking position B. As, upon normal closing, when the closed position SS is reached, no force is exerted from the exterior on the moveable furniture part 2, and the resetting movement T begins at the latest when the closed position SS is reached. With the end of that resetting movement T, the blocking element 4 also moves from the blocking position B into the release position F again. Then, as indicated by the dotted illustration, it is possible to wait for unlocking as long as may be desired. As soon as an operator would like to open the moveable furniture part 2 he presses against the moveable furniture part 2, in the closing direction SR whereby the moveable furniture part passes into the over-pressing region Ü between the closed position SS and the over-pressing position ÜS. In that way, the ejection device 3 is unlocked and the moveable furniture part 2 is ejected in the opening direction OR.

Figure 17:
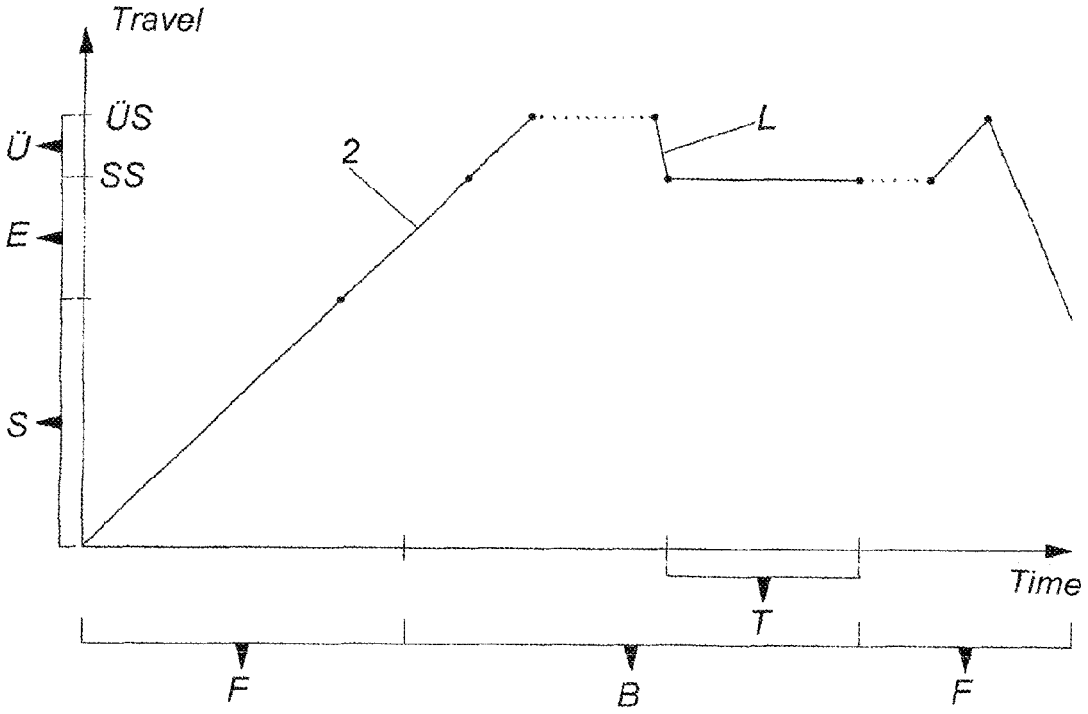
FIG. 17 shows a time-travel graph for the movement of the moveable furniture part when moved beyond the closed position.

In comparison, FIG. 17 diagrammatically shows the protection afforded by the present invention against the moveable furniture part being pushed through beyond the closed position. Once again, firstly at the beginning of the closing movement, a free-running portion (not shown) is moved by the moveable furniture part 2. As soon as the ejection roller 20 comes into contact with the control element 21, the stressing portion S of the drive device 1 is reached. During the movement along the retraction portion E, the blocking element 4 is moved into the blocking position B from the release position F. Subsequently upon reaching the closed position SS the moveable furniture part 2 is not stopped but the moveable furniture part is immediately pushed through into the over-pressing position ÜS. As the blocking element 4 is in the blocking position B the ejection device 3 cannot be unlocked and there is no ejection of the moveable furniture part 2 in the opening direction OR in spite of the over-pressing action on the moveable furniture part. As long as the moveable furniture part 2 remains in the over-pressing position ÜS, the blocking element 4 also remains in the blocking position B (see the dotted line). It is only when the moveable furniture part 2 is released that the moveable furniture part 2, by virtue of the ejection force storage member 6 and the ejection lever 7, moves into the closed position SS again (see the releasing portion L). As soon as the moveable furniture part 2 is in that closed position SS the resetting movement T also begins again, produced by the resetting device 5. After the same period as in FIG. 16, that resetting movement T is concluded and the blocking element 4 again moves from the blocking position B into the release position F. Then, as in FIG. 16, it is possible to wait for triggering or unlocking as long as may be desired. Unlocking is again effected by over-pressing into the over-pressing position ÜS and then ejection of the moveable furniture part 2 by the ejection device 3 in the opening direction OR.

Figure 18:
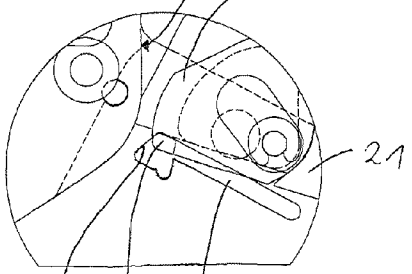

FIGS. 18 through 23*b* show a further embodiment of the present invention in which in particular the blocking element 4 is of a different configuration. In that respect, attention is firstly directed to FIG. 18. That FIG. 18 corresponds to the position of the drive device 1 as shown in FIG. 9. In other words, the moveable furniture part 2 has just been closed and the ejection roller 20 bears against the stressing portion S of the control element 21. That provides that the entire control element 21 is moved like from FIG. 8 to FIG. 9. With that movement, the blocking cam 31 is also moved towards the left along the guide path 10 in the locking base plate 8 until the blocking cam 31 contacts the diversion edge 38 as shown in FIG. 18. In FIG. 18 the moveable furniture part 2 is in the open position OS. The locking element 9 is already in the locking position V. In this embodiment, the locking element 9 at the same time forms the blocking element 4, being rotatable about the rotary bearing 32.

Figure 19:
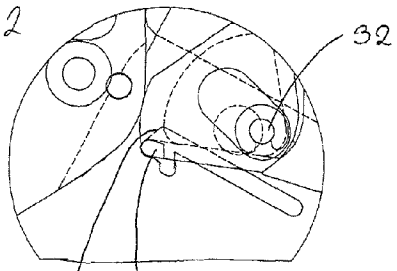

When as shown in FIG. 19 the control element 21 is further moved in the stressing phase, the blocking cam 31 is deflected by the diversion edge 38 whereby the blocking element 4 rotates in the counter-clockwise direction. Disposed in the region of the rotary bearing 32 or the blocking element 4 is a damping medium which takes over the function of the resetting device 5. The blocking element 4 is thus in the blocking position in FIG. 19.

Figure 20B:
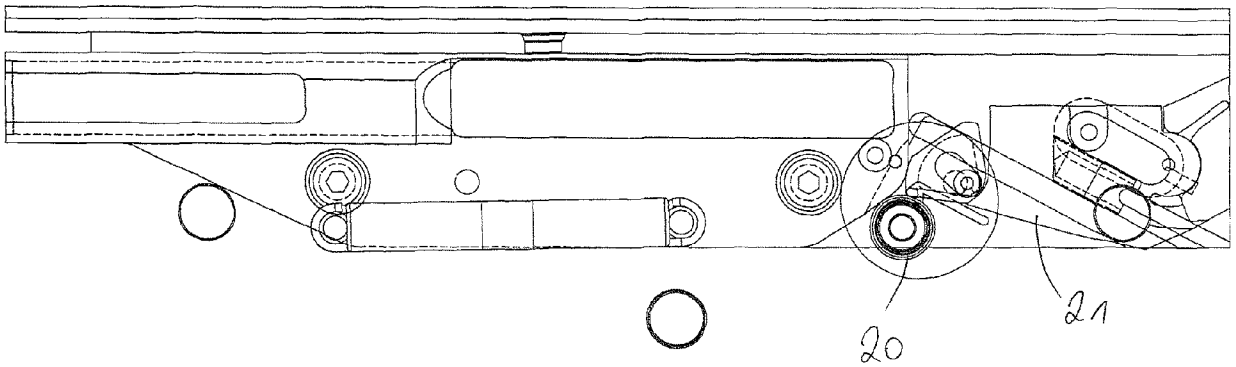
FIGS. 18 through 23*b* show an alternative embodiment of the blocking element.
Figure 20A:
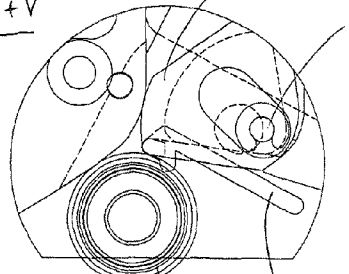

As shown in FIGS. 20*a* and 20*b*, in the further closing process, the ejection roller 20 passes beyond the locking element 9 or the blocking element 4 whereby the closed position SS of the moveable furniture part 2 is reached.

Figure 21B:
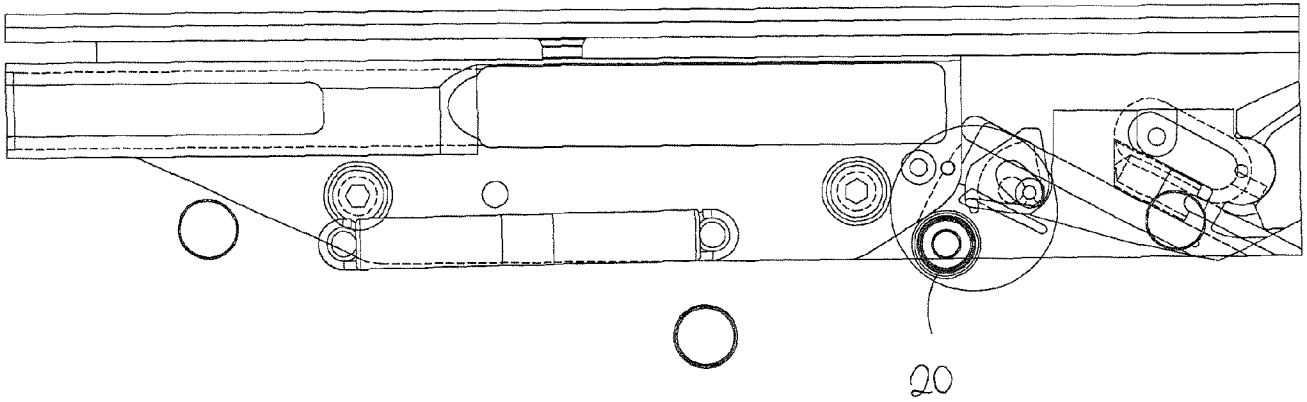
Figure 21A:
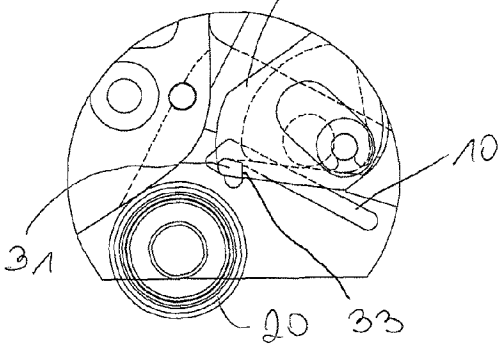

If the moveable furniture part 2 is immediately pushed further through into an over-pressing position ÜS, as shown in FIGS. 21*a* and 21*b*, the ejection roller 20 admittedly lifts off the locking element 9, but there is only a short movement of the entire control element 21 as that movement is immediately stopped by the control cam 31 meeting the control flank 33. Thus, the blocking position B is at least temporarily maintained in that over-pressing position ÜS.

Figure 22B:
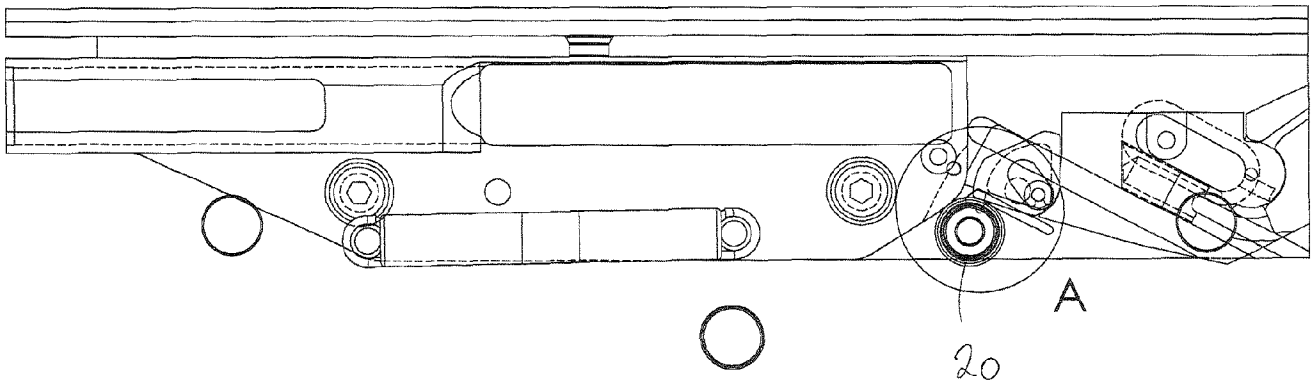
Figure 22A:
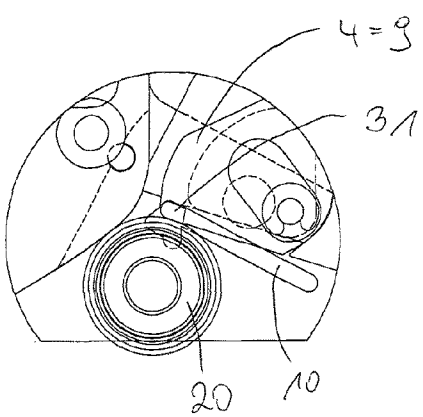
Figure 23B:
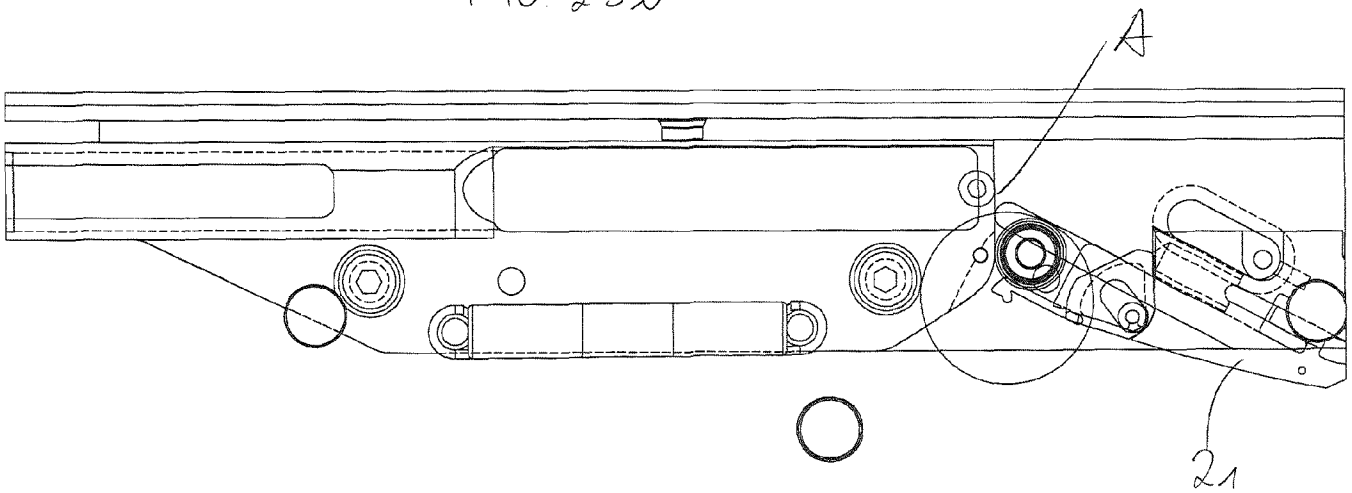
Figure 23A:
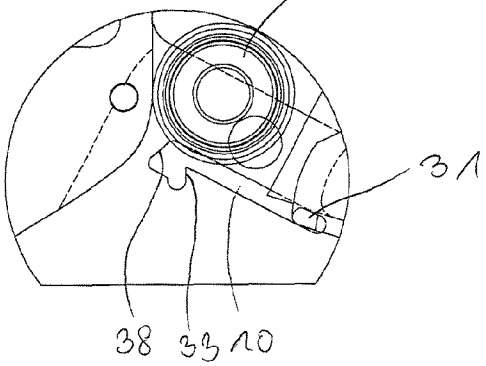

After a short period of a few seconds the blocking element 4 is rotated in the clockwise direction again by virtue of the yielding force of the damping medium whereby the blocking element 4 passes into the release position F shown in FIGS. 22*a* and 22*b*. The ejection roller 20 however is still bearing against the blocking element 4 or the locking element 9, and for that reason no unlocking and thus no ejection occurs, on the basis of the prevailing locking position V.

It is only when "normal" or desired over-pressing is effected, starting from that position, that unlocking and ejection as already described in relation to FIGS. 3 and 4 take place. In that case, as in FIGS. 23*a* and 23*b*, the ejection roller 20 passes into the ejection portion A as that was enabled by the control element 21. In that movement of the control element 21 towards the right the blocking cam 31 also moves along the guide path 10.

Thus the present invention provides an alternative protection against the moveable furniture part being pressed through beyond the closed position, in which unlocking of the ejection device 3 is prevented for a certain time after the closed position SS is reached. Unlocking is entirely prevented as long as the moveable furniture part 2 is still in the over-pressing position ÜS, after having been pressed beyond the closed position.

In the embodiment shown in this application, the ejection lever 7 is associated with the moveable furniture part 2 and bears against an ejection abutment 27 associated with the furniture carcass 14. In principle, however, the reverse variant is also conceivable, wherein an ejection lever 7 associated with the furniture carcass 14 ejects the moveable furniture part 2. The individual components can be fixed to the extension guide assembly 16 in respect of all thereof, some or not at all. That variant of the protection against over-pressing correspondingly applies to all variant configurations. In particular, this over-pressing protection does not necessarily have to be limited to an ejection device 3 with a pivotable ejection lever 7, but it can naturally also be correspondingly implemented in the case of a linearly moveable ejection element with a cardioid-shaped guide path. Besides a drawer the moveable furniture part 2 can also be a furniture flap, furniture door or the like.

The invention claimed is:

1. A drive device for a moveable furniture part, said drive device comprising:

a lockable ejection device for ejecting the moveable furniture part from a closed position into an open position, said ejection device configured to be unlocked by over-pressing the moveable furniture part into an over-pressed position beyond the closed position in a closing direction;

a blocking element configured to be moveable between (i) a blocking position in which said blocking element prevents unlocking of said ejection device when the moveable furniture part is in the over-pressed position, and (ii) a release position in which said ejection device is unlockable when the moveable furniture part is in the over-pressed position; and a resetting device for moving said blocking element from the blocking position into the release position, said resetting device being configured to effect a resetting movement of said blocking element in a time-delayed relationship such that the resetting movement of said blocking element begins at the latest when the moveable furniture part reaches the closed position.

2. The drive device as set forth in claim 1, wherein said blocking element is configured to be moved into the blocking position before the moveable furniture part is in the closed position.

3. The drive device as set forth in claim 2, wherein said resetting device is configured such that the moveable furniture part is in the closed position when said resetting device returns said blocking element to the release position.

4. The drive device as set forth in claim 1, wherein the resetting movement is between 0.2 second and 4 seconds.

5. The drive device as set forth in claim 4, wherein the resetting movement is between 0.3 second and 1 second.

6. The drive device as set forth in claim 1, wherein said ejection device includes a force-actuated ejection lever and an ejection force storage member for actuating said ejection lever, said drive device further comprising:

a locking base plate; and a locking element moveable along said locking base plate, said ejection lever bearing against said locking element in the closed position;

wherein said ejection lever and said locking element are configured such that, in the closed position, said locking element in a locking position blocks a path of movement of said ejection lever into an ejection area, and, in the over-pressed position, said locking element in a release position allows said ejection lever to move along the path of movement of said ejection lever into the ejection area.

7. The drive device as set forth in claim 6, wherein said blocking element is mounted rotatably on said locking element.

8. The drive device as set forth in claim 6, wherein said blocking element is moveable into the blocking position in a closing movement by said ejection lever.

9. The drive device as set forth in claim 6, wherein said blocking element is configured to prevent movement of said locking element into the release position while said blocking element is in the blocking position.

10. The drive device as set forth in claim 6, wherein said blocking element is mounted so as to have limited movement within a guide path in said blocking base plate.

11. The drive device as set forth in claim 10, wherein said blocking element is wedged in the blocking position in the guide path.

12. The drive device as set forth in claim 1, further comprising a retraction device for retracting the moveable furniture part.

13. The drive device as set forth in claim 12, wherein said retraction device is formed of an ejection lever of said ejection device.

14. The drive device as set forth in claim 13, further comprising a control path configured such that said ejection lever of said ejection device bears against an ejection portion of said control path upon ejection of the moveable furniture part, such that said ejection lever bears against a stressing portion of said control path upon stressing of an ejection force storage member of said ejection device, and such that said ejection lever bears against a retraction portion of said control path upon retraction of the moveable furniture part into the closed position while said ejection levers functions as said retraction device.

15. An article of furniture having said drive device as set forth in claim 1.

16. A method of opening and closing a moveable furniture part using the drive device as set forth in claim 1, said method comprising:

ejecting the moveable furniture part from the closed position into the open position by the lockable ejection device, the ejection device being unlocked by over-pressing the moveable furniture part into the over-pressed position beyond the closed position in the closing direction;

moving the blocking element of the drive device upon closing of the moveable furniture part into the blocking position in which unlocking of the ejection device is prevented upon reaching the over-pressed position; and moving the blocking element from the blocking position into the release position in which unlocking of the ejection device occurs upon reaching the over-pressed position.

17. The method as set forth in claim 16, wherein said moving of the blocking element from the blocking position into the release position is effected while the moveable furniture part is in the closed position in a time-delayed relationship by the resetting device, the time delay being between 0.2 and 4 seconds.

18. A drive device for a moveable furniture part, said drive device comprising:

a lockable ejection device for ejecting the moveable furniture part from a closed position into an open position, said ejection device configured to be unlocked by over-pressing the moveable furniture part into an over-pressed position behind the closed position relative to a closing direction, said ejection device including a force-actuated ejection lever and an ejection force storage member for actuating said ejection lever;

a blocking element configured to be moveable between (i) a blocking position in which said blocking element prevents unlocking of said ejection device when the over-pressed position is reached, and (ii) a release position in which said ejection device unlockable when the over-pressed position is reached;

a locking base plate; and a locking element moveable along said locking base plate, said ejection lever bearing against said locking element in the closed position;

wherein said ejection lever of said ejection device and said locking element are configured such that, in the closed position, said locking element in a locking position blocks a path of movement of said ejection lever into an ejection area, and, in the over-pressed position, said locking element in a release position allows said ejection lever to move along the path of movement of said ejection lever into the ejection area; and wherein said blocking element is mounted rotatably on said locking element.

19. The drive device as set forth in claim 18, wherein said blocking element is moveable into the blocking position in a closing movement by said ejection lever.

20. The drive device as set forth in claim 18, wherein said blocking element is configured to prevent movement of said locking element into the release position while said blocking element is in the blocking position.

21. The drive device as set forth in claim 18, wherein said blocking element is mounted so as to have limited movement within a guide path in said blocking base plate.

22. The drive device as set forth in claim 21, wherein said blocking element is wedged in the blocking position in the guide path.

23. A drive device for a moveable furniture part, said drive device comprising:

a lockable ejection device for ejecting the moveable furniture part from a closed position into an open position, said ejection device configured to be unlocked by over-pressing the moveable furniture part into an over-pressed position behind the closed position relative to a closing direction;

a blocking element configured to be moveable between (i) a blocking position in which said blocking element prevents unlocking of said ejection device when the over-pressed position is reached, and (ii) a release position in which said ejection device unlockable when the over-pressed position is reached;

a retraction device for retracting the moveable furniture part, said retraction device being formed of an ejection lever of said ejection device; and a control path configured such that said ejection lever of said ejection device bears against an ejection portion of said control path upon ejection of the moveable furniture part, such that said ejection lever bears against a stressing portion of said control path upon stressing of an ejection force storage member of said ejection device, and such that said ejection lever bears against a retraction portion of said control path upon retraction of the moveable furniture part into the closed position while said ejection levers functions as said retraction device.

* * * * *